US009593534B2

(12) United States Patent
Toler, Jr.

(10) Patent No.: US 9,593,534 B2
(45) Date of Patent: Mar. 14, 2017

(54) AXIS OFFSET CAM TOOL FOR REVERSE CIRCULATION EXPLORATION DRILLING SYSTEMS AND METHOD OF USE THEREOF

(71) Applicant: Jimmy Edward Toler, Jr., Mesa, AZ (US)

(72) Inventor: Jimmy Edward Toler, Jr., Mesa, AZ (US)

( * ) Notice: Subject to any disclaimer, the term of this patent is extended or adjusted under 35 U.S.C. 154(b) by 332 days.

(21) Appl. No.: 14/195,261

(22) Filed: Mar. 3, 2014

(65) Prior Publication Data

US 2015/0041218 A1 Feb. 12, 2015

Related U.S. Application Data

(60) Provisional application No. 61/863,329, filed on Aug. 7, 2013, provisional application No. 61/886,287, filed on Oct. 3, 2013.

(51) Int. Cl.

| | |
|---|---|
| ***E21B 17/10*** | (2006.01) |
| ***E21B 7/06*** | (2006.01) |
| *E21B 17/00* | (2006.01) |

(52) U.S. Cl.

CPC ..... *E21B 7/062* (2013.01); *E21B 17/10* (2013.01); *E21B 17/1064* (2013.01); *E21B 17/00* (2013.01)

(58) Field of Classification Search

CPC ..... E21B 17/1064; E21B 17/10; E21B 7/062; E21B 7/10

See application file for complete search history.

(56) References Cited

U.S. PATENT DOCUMENTS

| | | | | |
|---|---|---|---|---|
| 3,352,370 | A | 11/1967 | Livingston | |
| 3,799,279 | A * | 3/1974 | Farris | E21B 7/06 175/325.3 |
| 4,076,084 | A | 2/1978 | Tighe | |
| 4,220,213 | A | 9/1980 | Hamilton | |
| 4,501,336 | A | 2/1985 | Kemp et al. | |
| 4,715,453 | A | 12/1987 | Falgout, Sr. et al. | |
| 4,770,258 | A * | 9/1988 | Falgout, Sr. | E21B 7/06 175/325.2 |
| 4,995,466 | A | 2/1991 | Snow, Jr. | |
| 5,261,498 | A * | 11/1993 | Steinkamp | E21B 17/1064 175/325.3 |
| 2002/0056574 | A1 | 5/2002 | Harvey et al. | |

* cited by examiner

*Primary Examiner* — David Bagnell
*Assistant Examiner* — Kristyn Hall
(74) *Attorney, Agent, or Firm* — Schmeiser, Olsen & Watts LLP

(57) ABSTRACT

An off-axis "cam" drilling tool is provided. The off-axis "cam" drilling tool includes an outer tubing having a throughbore therein, an inner tubing having a throughbore therein, the inner tubing being configured to be inserted within the throughbore of the outer tubing. An annulus is defined between the inner tubing and the throughbore of the outer tubing through which a medium may pass. A cam section can be configured on a portion of the exterior surface of the outer tubing. The outer tubing can be coupled to drill rods of a drill string. The cam section has an axis that is offset to an axis of the outer tubing, and the tool is configured to rotate about cam section axis to lift the drill rods coupled to the outer tubing above a centerline of a drill bore to beneficially orient the drill bit drilling the drill bore.

12 Claims, 17 Drawing Sheets

AXIS OFFSET CAM TOOL FOR REVERSE CIRCULATION EXPLORATION DRILLING SYSTEMS AND METHOD OF USE THEREOF

CROSS REFERENCE TO RELATED APPLICATIONS

This application claims priority to U.S. Provisional Patent Application to Toler entitled "AXIS OFFSET CAM TOOL FOR REVERSE CIRCULATION EXPLORATION DRILLING SYSTEMS AND METHOD OF USE THEREOF," Ser. No. 61/863,329, filed Aug. 7, 2013, and to U.S. Provisional Patent Application to Toler entitled "AXIS OFFSET CAM TOOL FOR REVERSE CIRCULATION EXPLORATION DRILLING SYSTEMS AND METHOD OF USE THEREOF," Ser. No. 61/886,287, filed Oct. 3, 2013, the disclosures of which are hereby incorporated entirely herein by reference.

BACKGROUND

Technical Field

This disclosure relates generally to drilling tools, and in particular to a tool that may be configured in a reverse circulation exploration drilling system to guide the drilling operation toward the desired underground target.

State of the Art

Drilling is used around the globe as a means for accessing oil, water, geothermal and mineral resources within the Earth and gathering the resources therefrom. For example, water wells are traditionally formed through conventional drilling techniques, where wells are drilled vertically from the surface. Mineral exploration and mine development includes drilling to locate the minerals to be mined and using the extracted information by drilling to mine proven resources. Other drilling techniques, such as directional drilling are used to access underground locations in environmentally sensitive areas, so as to not have an environmental impact on the surface. Surface reverse circulation drilling is also utilized in underground mine rescue situations.

Yet, regardless of the type of drilling method utilized or the purpose for which the drilling is commenced, accuracy of the drilling system is paramount. Without accurately drilling and intercepting the intended target within the ground, the drilling operation will have expended significant sums of money to drill one or more holes without positive result. Generally by contractual agreement the drilling contractor is responsible for controlling deviation to reach the intended target within the ground.

Thus, prior to even beginning to drill, geologists take great care to attempt to pinpoint, or at least generally locate, the mineral resource to be drilled. Geologists map surface features that might indicate mineral resources under the ground. Geologists look for ore deposits using geophysical surveys. Geologists also use seismic surveys to map the location of petroleum resources within the earth. Seismic surveys utilize seismic waves that are sent down into the ground. These waves bounce off various features in the Earth and return to the surface at varying speeds, which the geologists may use to analyze and categorize what the ground may look like under the surface. In other words, geologists may get a picture of the composition of the ground at that particular location.

If these pre-drilling studies are positive, then it might justify test drilling, wherein one or more test wells are drilled in an attempt to evaluate the natural resources from the intended drill target for verification. Yet, even at this stage, geologists can come up with disappointing results if the drilling system is not able to accurately reach and access the predetermined underground target that the pre-drilling study has indicated is present.

Reverse circulation (RC) drilling is an example of type of drilling method that may be utilized as an exploratory drilling technique to reach predetermined locations (targets) under the ground and intercept mineral resources that may or may not exist. "Angle" drilling may be utilized with RC drilling, such that the drill string of the RC drilling system is angled from the vertical a certain number of degrees and enters the ground at this predetermined angle. Thereafter, whether the drill string accurately reaches the predetermined target under the ground is entirely up to the drill system components and the drill system operators.

In view of these difficulties, it is paramount that the drilling technique and the drilling system to be precise enough to locate and reach the exact location of the mineral resources determined by pre-drill study. For example, if the drill hole starts out at the surface in the direction of the mineral resource deep within the Earth and the drilling system cannot maintain course to the intended target of the mineral resource, then by the time the drilling system reaches the depth where the mineral resource is estimated, the drilling system may actually have deviated off target and miss the mineral target entirely. For example, the Chilean mine rescue in 2010 utilized 10 reverse circulation drilling rigs and took two weeks to intercept a target (i.e., the trapped miners) due to the problems associated with deviation of the drill holes.

Accordingly, there is a need in the drilling industry for tools that can be utilized by drill system operators to create an accurate drilling system that can drill an accurate enough hole in the Earth to reach a predetermined location within the depths of the Earth.

SUMMARY

The present disclosure relates to drilling tools, and in particular to a cam drilling tool that may be configured in a drilling system to guide the drilling operation toward the desired underground location.

An aspect of the present disclosure includes a drill string tool configured to be placed in a drill string. The tool may comprise a tubular body having an axis and a through bore defined by a sidewall, an exterior portion of the sidewall having a cylindrical surface, the cylindrical surface of the sidewall having a first diameter, a cam body configured on the tubular body, an exterior portion of the cam body having a cylindrical surface, the cylindrical surface of the cam body having a second diameter, and an offset section on the cam body defined by the first and second diameters being substantially internally tangent with respect to a first side of the tool, such that the offset section protrudes from the cam body with respect to a second side of the tool opposite the first side, wherein the tubular body having the cam body thereon is configured to be inserted in a drill string and to rotate with the drill string.

Another aspect of the present disclosure includes wherein the tubular body is comprised of a first body and a second body that are configured to be releasably and repeatedly coupled in series to form the tubular body, the cam body being configured on the second body.

Another aspect of the present disclosure includes wherein the tubular body is comprised of a first body and a second body that are configured to be releasably and repeatedly coupled in series to form the tubular body, and wherein the cam body is a sleeve, the sleeve being configured to be repeatedly and releasably functionally coupled on the tubular body.

Another aspect of the present disclosure includes an internal tubular body that is configured to be inserted within the through bore of the tubular body to functionally engage the tubular body, the tubular body and the internal tubular body defining a hollow annulus therebetween.

Another aspect of the present disclosure includes wherein the offset section comprises tapered leading edges, wherein the offset section comprises one or more grooves therein, and wherein the offset section has an axial length less than a length of the tubular body Another aspect of the present disclosure includes wherein the offset section comprises an offset axis, the axis and the offset axis being offset an offset distance from one another and substantially parallel with one another.

Another aspect of the present disclosure includes wherein the cylindrical surface of the sidewall and the cylindrical surface of the cam body are each substantially parallel with the axis.

Another aspect of the present disclosure includes a drill string tool configured to be placed in a drill string, the tool comprising an inner tubing, an outer tubing having a throughbore, the outer tubing being configured to receive at least a portion of the inner tubing within the throughbore, the inner and outer tubing being configured to rotate about a first axis, a hollow annulus defined between the inner tubing and the outer tubing, and a cam section extending from an exterior surface of the outer tubing, the cam section having a cam axis that is substantially parallel to the first axis and offset an offset distance from the first axis, wherein under a condition the tool is coupled to a drill string and the drill string is rotated within a drill hole, the cam section is configured to periodically lift a portion of the drill string off a surface of the drill hole.

Another aspect of the present disclosure includes wherein the outer tubing has a first diameter and the cam section has a second diameter larger than the first diameter.

Another aspect of the present disclosure includes wherein the second diameter of the cam section is configured to functionally engage the drill hole during rotation of the drill string and results in the first axis rotating about the cam axis in the tool to periodically lift the portion of the drill string off the surface of the drill hole.

Another aspect of the present disclosure includes wherein the first diameter and the second diameter are each cylindrical-shaped surfaces.

Another aspect of the present disclosure includes wherein the outer tubing is comprised of a first body and a second body that are configured to be releasably and repeatedly coupled in series to form the outer tubing, the cam section being configured on the second body.

Another aspect of the present disclosure includes wherein the outer tubing is comprised of a first body and a second body that are configured to be releasably and repeatedly coupled in series to form the outer tubing, and wherein the cam section is a sleeve, the sleeve being configured to be repeatedly and releasably functionally coupled on the outer tubing.

Another aspect of the present disclosure includes a method of deep hole drilling, the method comprising providing a drilling system, inserting a drilling tool in a drill string having drill rods and a drill bit, the drilling tool comprising a first diameter and a second diameter greater than the first diameter, the first and second diameters being offset an offset distance from one another, and drilling a drill hole using the drill string having the drilling tool positioned therein, and guiding the drill bit by adjusting the offset distance.

Another aspect of the present disclosure includes wherein the first and second diameters are internally tangent on a side of the drilling tool to create the offset distance on an opposing side of the drilling tool.

Another aspect of the present disclosure includes periodically displacing the drill string within the drill hole due to rotation of the drill string and the offset distance.

The foregoing and other features, advantages, and construction of the present disclosure will be more readily apparent and fully appreciated from the following more detailed description of the particular embodiments, taken in conjunction with the accompanying drawings.

BRIEF DESCRIPTION OF THE DRAWINGS

Some of the embodiments will be described in detail, with reference to the following figures, wherein like designations denote like members.

DETAILED DESCRIPTION OF EMBODIMENTS

A detailed description of the hereinafter described embodiments of the disclosed apparatus and method are presented herein by way of exemplification and not limitation with reference to the Figures listed above. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1:
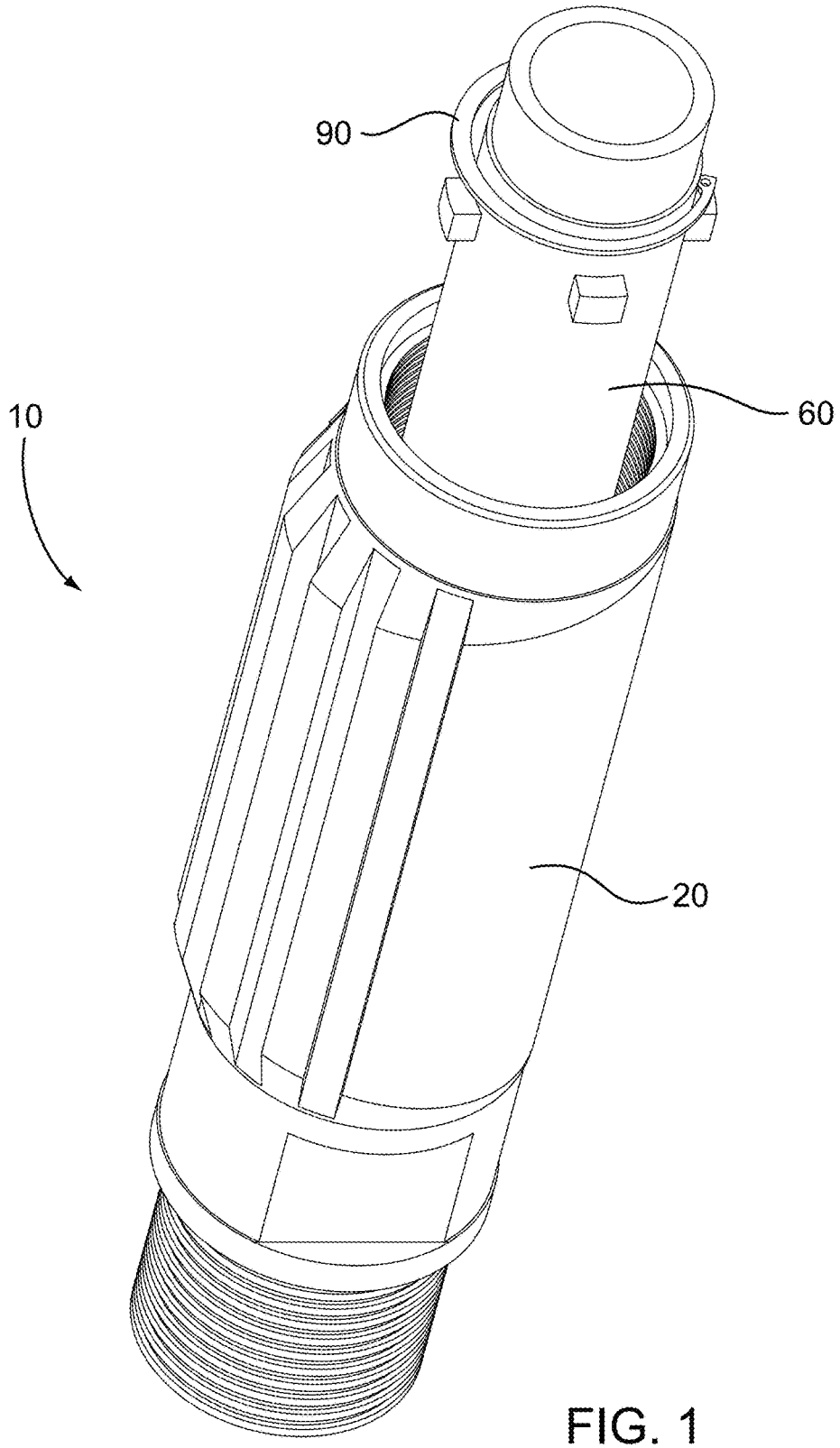
FIG. 1 is a semi-exploded perspective view of an embodiment of an axis-offset cam drilling tool in accordance with the present disclosure.

Referring to the drawings, FIG. 1 depicts an embodiment of an axis offset "cam" drilling tool 10, in accordance with the present disclosure. The off-axis "cam" drilling insert tool 10 may comprise an outer tubing 20, an inner tubing 60, and an off-axis cam section 30 that structurally and functionally communicate with one another as described herein to effectuate the performance of the tool 10 for its intended purposes. The tool 10 may be utilized in drilling operations to more effectively guide the drilling system to its intended target below the surface of the ground. In particular, the tool 10 may be inserted into the drill string of a drilling system to more effectively guide the drill bit to its intended target beneath the surface of the Earth. The tool 10 may also be referred to as an insert, an instrument, a gadget, an implement, an apparatus, equipment, machinery, or a device.

Figure 6A:
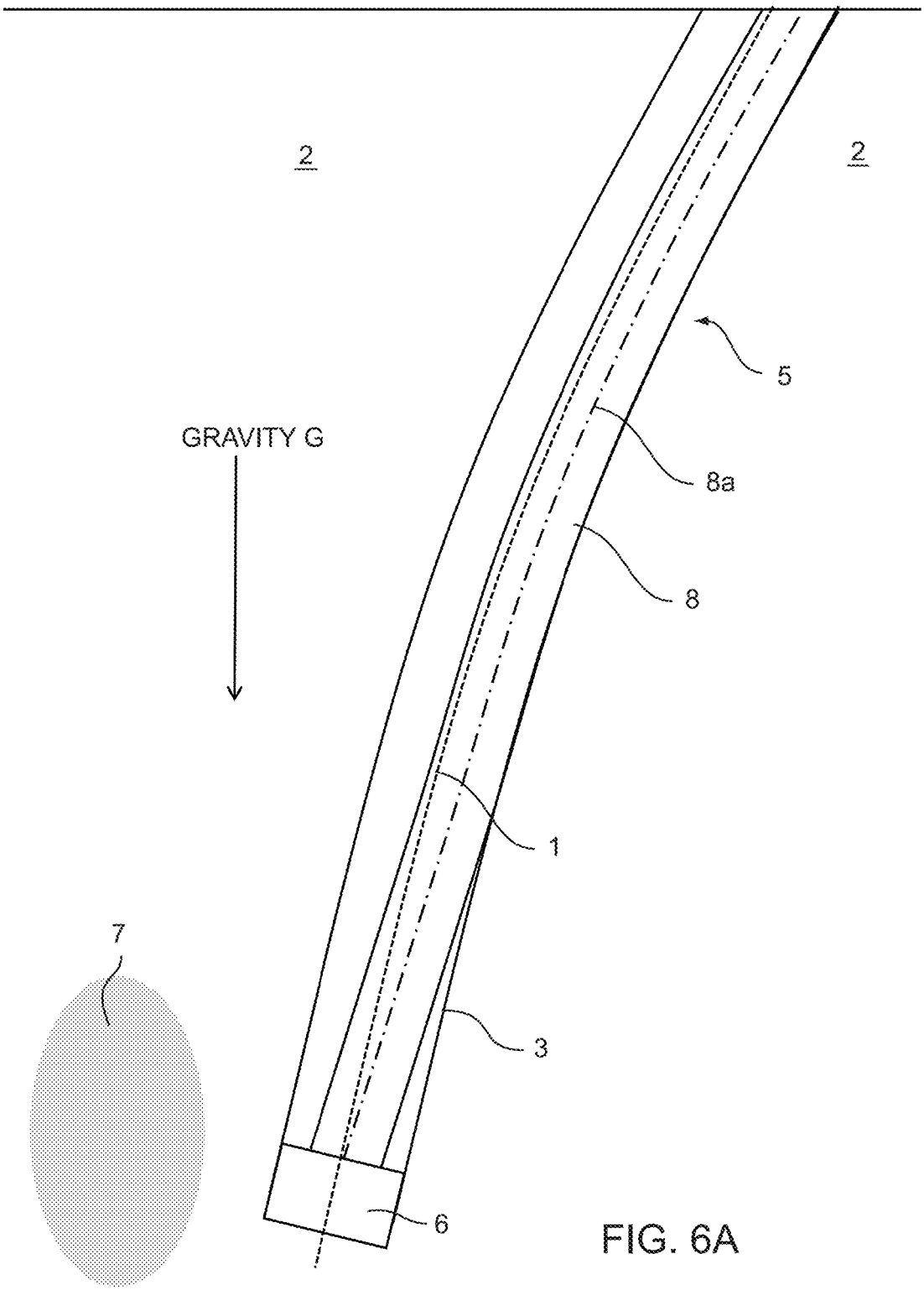
FIG. 6A is a cross-sectional view of a drill hole having a conventional drill string positioned therein in accordance with the present disclosure.

With reference now to FIG. 6A, a conventional drill string 8 of a drilling system may be utilized to attempt to reach an intended target 7 below the surface of the ground 2. The drill string 8 may comprise a drill bit 6, drill bit adapter 9, pneumatic conventional hammer, or pneumatic reverse circulation hammer, and one or more drill rods 4. The drill string 8 may be used to carve a drill hole 5 into the ground 2, whether the drill hole 5 is vertical to the ground surface or somewhat offset thereto, as shown. The drill string 8 may be made to be as long or as short as needed to reach the desired location within the ground 2. To lengthen the drill string 8, additional drill rods 4 may be coupled to one another, end to end, such that the drill string 8 may reach deep within the ground 2. The drill bit 6 may be placed at the terminal end of the drill string 8 such that the drill bit 6 may come into contact with the ground 2 to be drilled into. Rotation of the drill string 8 and operation of the drill bit 6 may cause the drill bit 6 to drill deep into ground 2.

In a conventional rotational drilling configuration, such as a RC drilling operation depicted in FIG. 6A, as a drill string 8 reaches deep within the ground 2 in a slant drilling operation, gravity G, indicated by the arrow G in FIG. 6A, may act on the drill bit 6 and/or drill string 8 to pull the drill string 8 and the drill bit 6 to the bottom surface 3 of the drill hole 5, such that the drill bit 6 ever-so-slightly over time drills deeper down into the ground than is desired or intended. The normal or conventional position of the drill string 8 is depicted in FIG. 6A, with the drill string 8 lying on or being positioned in close proximity to the underside surface 3 of the drill hole 5. The drill string 8 resides on the bottom surface 3 for most of the length of the drill string 8. Moreover, the centerline 8*a* of the drill string 8 is below the centerline 1 of the drill hole 5 for most, if not all, of the length of the drill hole 5, as depicted in FIG. 6A. Also, because of the configuration of the conventional rotational drilling configuration, the centerline 8*a* of the drill string 8 is certainly not positioned above the centerline 1 of the drill hole 5 at any point along the length of the drill hole 5 and may only be equal to the centerline 1 of the drill hole 5 at the point the drill string 8 couples to the drill bit 6. For example, a conventional drill rod 4 is smaller in diameter than the diameter of the drill bit 6. Thus, the smaller diameter drill rods 4 tend to rest on the bottom surface 3 of the drill hole 5, which has a larger diameter than that of the drill rods 4, or a diameter about the size of the drill bit 6. The weight of the drill string 8 causes a downward force on the drill string 8 and the drill bit 6 that tends to increase the "dip angle" of the drill hole 5 over time. For example, although the effect of gravity G may be slight, after drilling a significant distance within the ground 2, this slight effect of gravity G on the conventional drill string 8 may cause the conventional drill string 8 and drill bit 6 to "sag" or "dip", causing the drilling system to miss the intended target 7, as depicted in FIG. 6A. By missing the intended target 7, the drilling operator and drilling company miss out on the monetary benefit, in the form of natural resources, located at the intended target 7. As a result, a new drill hole may be started, at considerable expense, or, in the alternative, the drilling operation may cease altogether due to operational losses stemming from the costs of drilling inaccurate and fruitless holes.

To solve this inaccuracy, the relative positioning of the following elements can be considered: (1) centerline axis 1 of the drill hole 5; (2) centerline axis of drill rods 4 along with the axis 27 of the outer body 20 of the off-axis "cam"

drilling tool 10; (3) off-axis centerline 39 of the off-axis "cam" drilling tool 10; and (4) the effects of gravity. These elements and their relative positional relationship will be described in greater detail below.

Figure 6B:
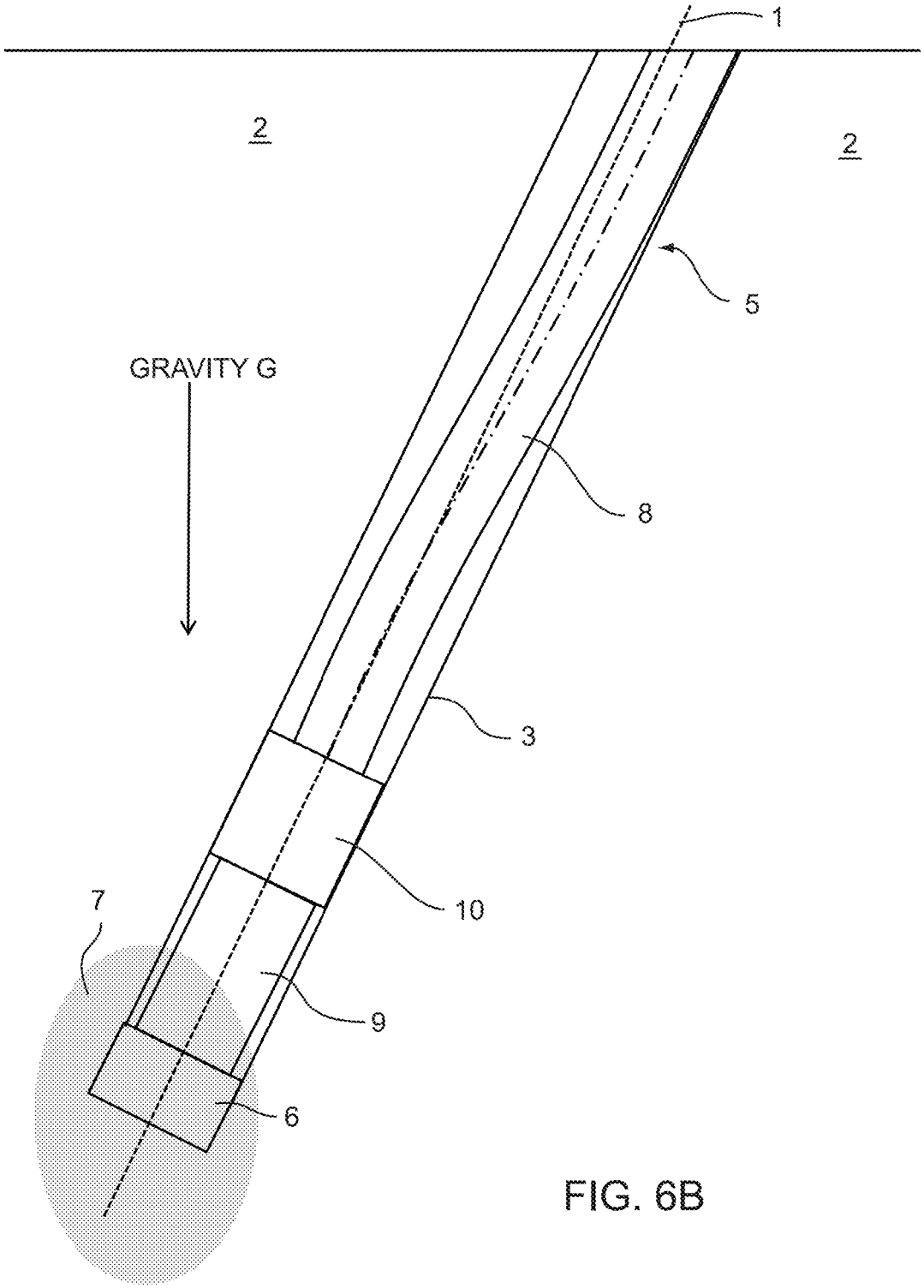
FIG. 6B is a cross-sectional view of a drill hole having a drill string positioned therein that utilizes the axis-offset cam drilling tool in accordance with the present disclosure.

Embodiments of the off-axis "cam" drilling tool 10 of the present disclosure, as exemplarily depicted in FIG. 6B and as described herein, may be inserted in the drill string 8 to help the drill bit 6 achieve the proper orientation and positioning within the drill hole 5 to assist in controlling the drill string 8 to drill an accurate drill hole 5 to reach the intended target 7 and to tap into the natural resources located there. The off-axis "cam" drilling tool 10 may be inserted with the drill string 8 of drilling systems, including a reverse circulation drilling system, to help reach an intended target 7. The off-axis "cam" drilling tool 10 may be inserted into the drill string 8 at a point that is advantageous to the operation of the drilling system. For example, the off-axis "cam" drilling tool 10 may be positioned directly behind the drill bit adapter (sub) 9, such that the tool 10 resides between the drill bit 6, drill bit adapter (sub) 9, and the first drill rod 4. Further in example, the off-axis "cam" drilling tool 10 may be positioned in the drill string 8 at a distance further from the drill bit 6 and drill bit adapter 9, such that one or more drill rods 4 are positioned between the drill bit 6/drill bit adapter 9 and the off-axis "cam" drilling tool 10. As an exemplary embodiment, the off-axis "cam" drilling tool 10 is depicted in FIG. 6B as positioned between the drill bit 6/drill bit adapter 9 and the first drill rod 4.

Embodiments of the off-axis "cam" drilling tool 10 may further comprise the off-axis "cam" drilling tool 10 being incorporated directly onto the drill bit adapter 9 itself, such that the drill bit adapter 9 and the off-axis "cam" drilling tool 10 are a unitary body or a single piece. In this way, the drill bit adapter 9, which incorporates the technology and function of the off-axis "cam" drilling tool 10, as described herein, may be directly coupled to the terminal drill rod 4. Embodiments of the off-axis "cam" drilling tool 10 may further comprise the off-axis "cam" drilling tool 10 being incorporated directly into the reverse circulation center flow adapter itself, such that the reverse circulation center flow adapter and the off-axis "cam" drilling tool 10 are a unitary body or a single piece. In this way, the reverse circulation center flow adapter which incorporates the technology and function of the off-axis "cam" drilling tool 10, as described herein, may be directly coupled to the terminal drill rod 4. Moreover, embodiments of the off-axis "cam" drilling tool 10 may further comprise the off-axis "cam" drilling tool 10 being incorporated directly into the upper connecting end of a pneumatic conventional or reverse circulation hammer itself, such that the hammer and the off-axis "cam" drilling tool 10 are a unitary body or single piece. In this way, the pneumatic conventional or reverse circulation hammer, which incorporates the technology and function of the off-axis "cam" drilling tool 10, as described herein, may be directly coupled to the terminal drill rod 4. Moreover, embodiments of the off-axis "cam" drilling tool 10 may further comprise the off-axis "cam" drilling tool 10 being incorporated directly onto the terminal end of a drill rod 4, such that the terminal drill rod 4 and the off-axis "cam" drilling tool 10 are a unitary body or single piece. In this way, the terminal drill rod 4, which incorporates the technology and function of the off-axis "cam" drilling tool 10, as described herein, may be directly coupled to the drill bit adapter 9 or pneumatic conventional or reverse circulation hammer.

Figure 2A:
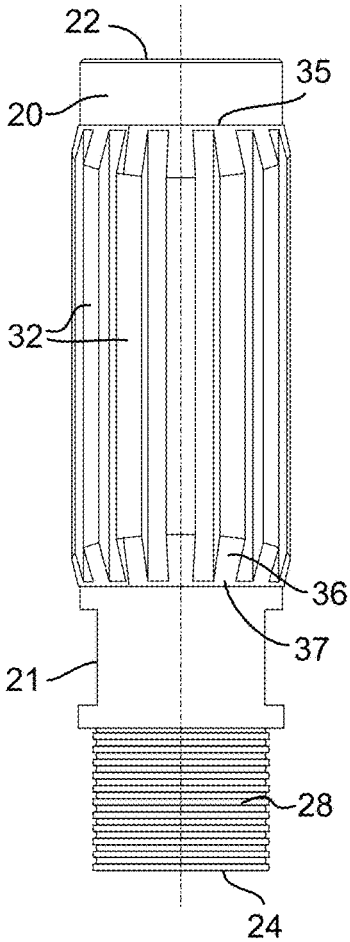
FIG. 2A is a front view of a component of the axis-offset cam drilling tool in accordance with the present disclosure.
Figure 2B:
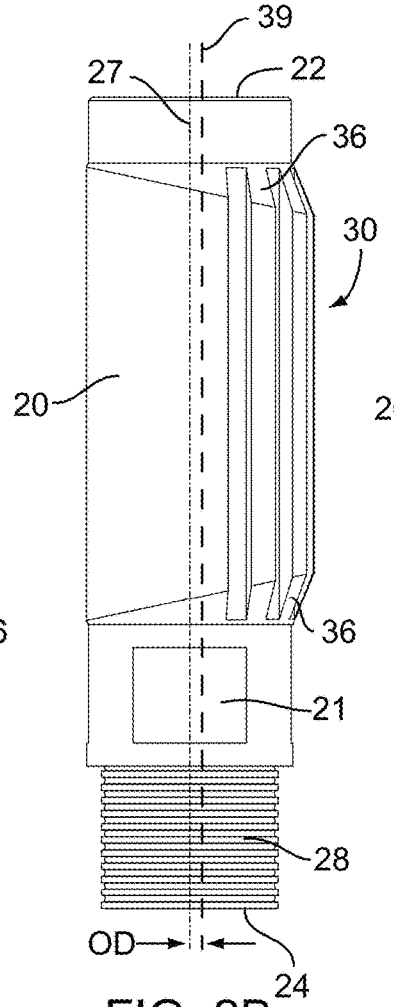
FIG. 2B is a side view of a component of the axis-offset cam drilling tool depicted in FIG. 2A in accordance with the present disclosure.
Figure 2C:
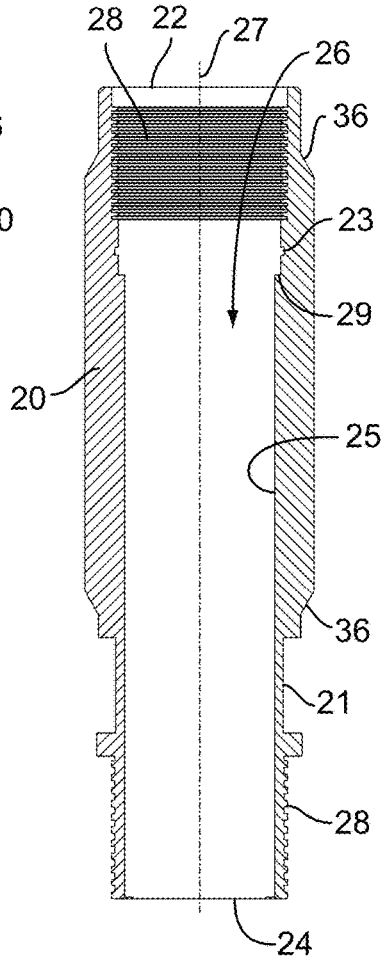
FIG. 2C is a cross-sectional view of the component of the axis-offset cam drilling tool depicted in FIG. 2A in accordance with the present disclosure.
Figure 2D:
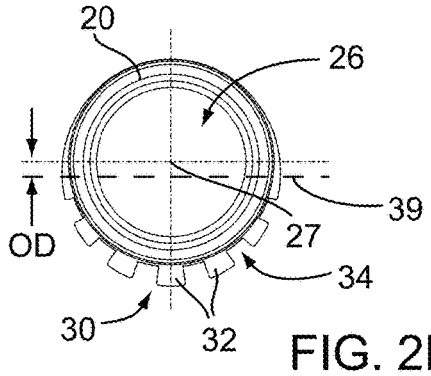
FIG. 2D is a top view of the component of the axis-offset cam drilling tool depicted in FIG. 2A in accordance with the present disclosure.

With reference now to FIGS. 2A-2D, embodiments of the off-axis "cam" drilling tool 10 may further comprise the outer tubing 20. The outer tubing 20 may be a tubular body configured in a tubular circular shape to facilitate rotational drilling of a drill system, such as a RC drilling system. The outer tubing 20, or tubular body, may have portions thereof that are non-cylindrical and portions thereof that are cylindrical and have an outer diameter. The outer tubing 20 may further comprise a first end 22, a second end 24, and a through bore 26 running the entire axial length of the outer tubing 20, such that the first end 22 and the second end 24 are open, as depicted in FIGS. 2C and 2D. The through bore 26 may be centered on an axis 27, such that any rotation of the outer tubing 20 may result in the outer tubing 20 rotating about the axis 27. The outer tubing 20 may further comprise threads 28 on an exterior surface of the first or second ends 22 and 24 and threads 28 on an interior surface of the remaining one of the first or second ends 22 and 24, such that the off-axis "cam" drilling tool 10 may be releasably and repeatedly coupled to one or more of a drill bit 6 and a drill rod 4 on one of the first or second ends 22 and 24 and a drill rod 4 on the remaining end of the first or second ends 22 and 24. In other words, the off-axis "cam" drilling tool 10 has exterior threads 28 and interior threads 28 configured thereon so that the tool 10 may be inserted in-line on the drill string 8 and may couple to other components of the drill string 8, such as the drill bit 6 and the drill rods 4. The outer tubing 20 may further comprise indentions 21 in an outer surface to facilitate the grip of fastening tools, such as a wrench, that may be utilized to tighten the tool 10 in the drill string 8.

Figure 4A:
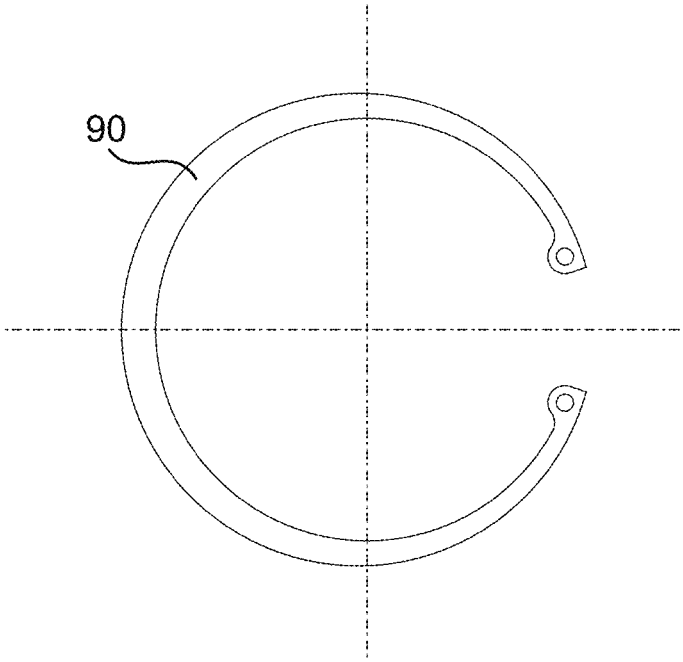
FIG. 4A is a top view of a component of the axis-offset cam drilling tool in accordance with the present disclosure.
Figure 4B:
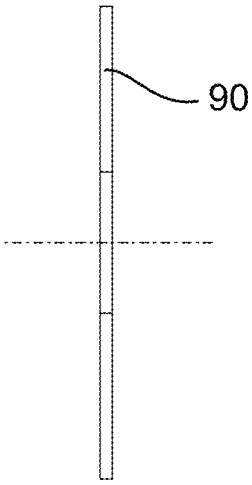
FIG. 4B is a side view of a component of the axis-offset cam drilling tool depicted in FIG. 4A in accordance with the present disclosure.
Figure 5:
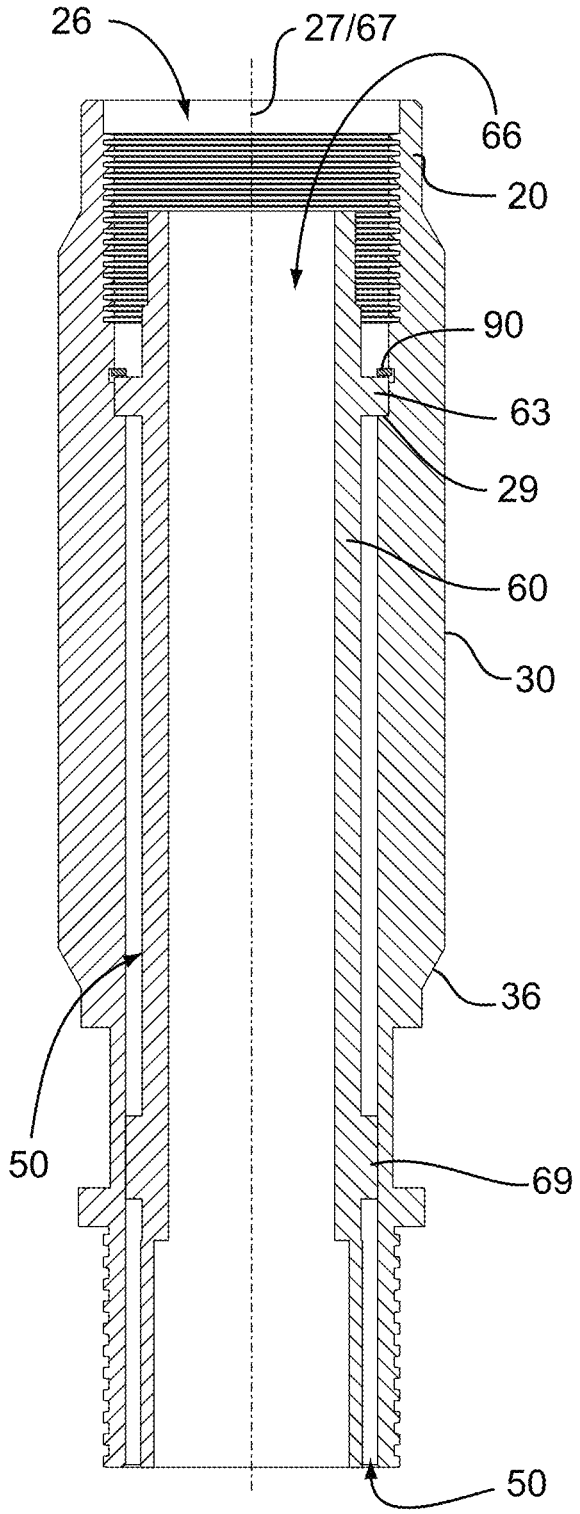
FIG. 5 is a cross sectional view of the axis-offset cam drilling tool in accordance with the present disclosure.

Embodiments of the off-axis "cam" drilling tool 10 may further comprise the outer tubing 20 having an interior surface 25 that defines the through bore 26. The through bore 26 may be circular in shape, such that it may coincide with the shape and size of the hollow string rods 4 of RC drilling systems. The interior dimensions of the through bore 26, such as the diameter, may be adjusted as needed depending on the implantation of the off-axis "cam" drilling tool 10 in various drilling applications. The outer tubing may further comprise an interior lip 29 and a interior grove 23 configured at separate locations on the interior surface 25. The interior lip 29 may be configured to receive and communicate with the inner tubing 60. The interior groove 23 may be configured to receive the c-ring clip 90, which is depicted in FIG. 4A. The clip 90 may be configured to be inserted into and sit within the interior groove 23 and communicate with not only the outer tubing 20 but also the inner tubing 60, such that the clip 90 may prevent axial retreat of the inner tubing 60 with respect to the outer tubing 20 once the inner and outer tubing 20 and 60 have been positioned relative to one another, as depicted in FIG. 5 and as described herein.

Embodiments of the off-axis "cam" drilling tool 10 may further comprise the outer tubing 20 having an off-axis cam section 30 configured with respect to the outer tubing 20. The off-axis cam section 30 may be a cylindrical "cam" body. The cam section 30 may have portions thereof that have an outer diameter that is larger than the outer diameter of the outer tubing 20, which may also be a cylindrical section, or at least have portions thereof that are cylindrical. In other words, the outer tubing 20 may have cylindrical sections that have a first diameter and the off-axis cam section 30 may have cylindrical sections that have a second diameter that are larger than the first diameter. In some embodiments, the first and second diameters may be internally tangent to one another on one side of the off-axis "cam" drilling tool 10, with an edge of the diameter of the outer tubing 20 being proximate the edge of the diameter of the cam section 30, at, for example and not in any way limiting, point E, as shown in FIGS. 2B and 2D, and yet the diameter of the outer tubing 20 being completely within the diameter of the cam section 30. As a result, the second diameter of the cam section 30 that is larger than the diameter of the outer tubing 20 causes the cam section 30 to protrude off the exterior surface of the outer tubing 20 a desired operating offset distance DOOD. This desired operating offset distance DOOD can be manipulated and determined by the user as needed to perform the desired drilling operation. The desired operating offset distance DOOD is usually two times the offset distance OD described below.

In accordance with the above, the off-axis cam section 30 may be configured to have an axis 39 that, although is substantially parallel to the axis 27 of the outer tubing 20, is axially offset thereto because of the differing diameters. For example, the axis 39 of the off-axis cam section 30 and the axis 27 can be separated by a distance OD (i.e., offset distance) in one direction. This offset distance OD between the axis 27 of the outer tubing 20 and the axis 39 of the cylindrical off-axis cam section 30 results in the off-axis cam section 30 protruding off of at least one side of the outer tubing 20. The offset distance OD may be substantially equal to one half the difference between the diameter of the cam section 30 and the diameter of the outer tubing 20. For example, as depicted in FIG. 2D, the off-axis cam section 30 is offset with respect to the axis 27, such that the individual cams 32 of the off-axis cam section 30 protrude from the outer surface of the outer tubing 20 a distance of 2*OD (two times the offset distance OD). The offset distance OD will usually be one half of the overall difference between the diameter of the cam section 30 and the diameter of the outer tubing 20, or the desired operating offset distance DOOD.

Embodiments of the off-axis "cam" drilling tool 10 may further comprise the off-axis cam section 30 having a diameter that may be slightly smaller than the diameter of the drill bit 6, but not by much. For example, in some embodiments, the diameter of the off-axis cam section 30 may be only 1/16 of an inch smaller than the diameter of the drill bit 6. This provides that the off-axis cam section 30 may reside within the drill hole 5 and yet rotate within the drill hole 5 as the drill rods 4 rotate within the drill hole 5. Moreover, because the diameter of the off-axis cam section 30 is more or less the same as the diameter of the drill bit 6, the off-axis cam section 30 does not "sag" or "dip" within the drill hole 5, which likewise prevents the tool 10 from "sagging" or "dipping" within the drill hole 5. In other words, the effects of gravity G on the tool 10 are minimized, or even eliminated, by the circular diameter of the off-axis cam section 30 being substantially the same as the circular diameter of the drill bit 6 or drill hole 5. In some embodiments, the axis 39 of the off-axis cam section 30 may be substantially axially aligned with the axis of the drill bit 6. The beneficial effects of such a configuration will be described in greater detail herein.

Embodiments of the off-axis "cam" drilling tool 10 may further comprise the off-axis cam section 30 having an axial length parallel to the axial length of the outer tubing 20. The length of the off-axis cam section 30 may run axially along the length of the outer tubing 20, but may not be configured to run along the entire length of the outer tubing 20. As depicted, the off-axis cam section 30 may be configured on about ½ to ⅔ of the length of the outer tubing 20. The off-axis cam section 30 may have a first end 35 and a second end 37. Embodiments of the off-axis cam section 30 may comprise each of the first and second ends 35 and 37 having a tapered section 36 that is angled with respect to the outer surface of the outer tubing 20. The tapered sections 36 may be leading edges. The tapered sections 36 may make it easier for the off-axis "cam" drilling tool 10 to operate within the drill hole 5 under normal operating conditions, and in particular while the off-axis "cam" drilling tool 10 is rotating with the drill string 8. The tapered sections 36 may allow the off-axis "cam" drilling tool 10 to avoid hanging up or snagging on the drill hole 5 as the drill string 8, and thus the off-axis "cam" drilling tool 10, move axially and radially within the drill hole 5.

The configuration of the off-axis "cam" drilling tool 10, as described herein, may be coupled in the drill string 8 and thereafter utilized to periodically lift, raise, exert force thereon, bow, deflect, or elastically bend the drill string 8 to move the drill string 8 out of the centerline axis 1 of the drill hole 5 and even above the centerline axis 1 at or near the point the drill string 8 is coupled to the off-axis "cam" drilling tool 10, as described herein. With the off-axis "cam" drilling tool 10 inserted within the drill string 8 at some point between the drill bit 6 and the drill rods 4, the centerline of the drill string 8 can be offset from the centerline 1 of the drill hole 5. This is different than in conventional reverse circulation drilling configurations where the centerline of the drill string is substantially and consistently the same as the centerline of the drill hole at the point the drill string meets the drill bit or drill bit adapter, even while rotating, according to FIG. 6A.

However, in embodiments of the present disclosure, the off-axis "cam" drilling tool 10 establishes advantages over the conventional drill string and drilling system described in FIG. 6A. For example, because the axis 27 of the outer body 20 and the axis of the drill string 8 at the connection point between the off-axis "cam" drilling tool 10 and the drill string 8 are substantially the same, and because the axis 39 of the off-axis cam section 30 is substantially the same as the centerline 1 of the drill hole 5 (due to the off-axis cam section 30 being substantially the same diameter as the drill hole 5), and because the axis 27 of the outer body 20 is not in alignment with the axis 39, the centerline axis of the drill string 8 is consequently not in alignment with the centerline 1 of the drill hole 5. Instead, as the drill string 8, the off-axis "cam" drilling tool 10 and drill bit 6 rotate within the drill hole 5, the axis 27 of the outer body 20 rotates radially about the axis 39 of the off-axis cam section 30 and thus the centerline of the drill string 8 rotates radially about the axis 39 of the off-axis cam section 30. As a result, the drill string 8 can be periodically positioned and/or lifted above the centerline axis 1 of the drill hole 5, which positioning exerts periodic forces on the drill string 8 to cause the drill string 8 to periodically bend, curve, deflect, bow or otherwise arc to exert forces on the drill bit 6 that cause the drill bit 6 to resist the natural forces of gravity G that might otherwise cause the drill bit 6 to dip.

With the off-axis "cam" drilling tool coupled to the drill string 8, the weight of the drill string 8 and the natural effects of gravity acting on the drill string 8 between the off-axis "cam" drilling tool 10 and a point in the drill hole 5 above the off-axis "cam" drilling tool 10 where the drill string 8 contacts the bottom surface 3 of the drill hole 5 can be used to advantageously position the drill bit 6. Under the condition the off-axis "cam" drilling tool 10 periodically raises the drill string 8 above the centerline 1 of the drill hole 5 the natural forces of gravity on the drill string 8 serve to periodically bow, deflect, or elastically bend the drill string 8 to cause a periodic deflection in the centerline axis of the drill rods 4, which consequently and periodically affects the directional orientation of the drill bit 6 against the natural forces of gravity G. In other words, the periodic centerline deflection of the drill rods 4 and thus the drill string 8 beneficially affects the directional orientation of the drill bit 6 in a direction contrary to the natural effects of gravity G. Indeed, equipping the off-axis "cam" drilling tool 10 in a reverse circulation drilling system in the manner herein described effectively eliminates the drilling system from deviating on "dip angle" more than is desired, and thus allowing the drilling system to intercept the intended target.

Embodiments of the off-axis "cam" drilling tool 10 may further comprise the off-axis cam section 30 being configured to have a larger or smaller offset distance OD from the axis 27 as the angle of the drill hole 5 increases or decreases from the vertical, respectively. In other words, as the orientation of the drill hole 5 is oriented further from the vertical, it may be necessary to adjust the offset distance OD of the off-axis cam section 30 with respect to axis 27 to help the drill bit 6 achieve the most appropriate directional orientation. As the orientation of the drill hole 5 moves further and further from the vertical, the effects of gravity on the drill string 8 and the drill bit 6 that orient the drill string 8 and drill bit 6 within the drill hole 5 increase. Accordingly, it may be necessary to increase the offset distance OD to combat these larger effects of gravity. Alternatively, as the orientation of the drill hole 5 moves closer and closer to the vertical, the effects of gravity on the drill string 8 and the drill bit 6 that orient the drill string 8 and drill bit 6 within the drill hole 5 decrease. Accordingly, it may be necessary to decrease the offset distance OD to offset these smaller effects of gravity. Implementing the off-axis cam section 30 with larger or smaller offset distances OD may require that one or more cam drilling tools 10 are manufactured with different offset distances OD according to the needs, type, and orientation of the drill hole 5 to be drilled. In addition to the effects of gravity G, the ground condition or ground type may be factored into the analysis and decision of what offset distance OD should be chosen for any particular drill hole 5 to be drilled.

An embodiment of the off-axis "cam" drilling tool 10 may have a certain offset distance OD, whereas another embodiment of the off-axis "cam" drilling tool 10 may be manufactured to have a different offset distance OD than that of the first, depending on the drill hole 5 to be drilled. For example, if it is desired to drill a 200 meter drill hole 5 at 60 degrees from the horizontal (or 30 degrees from the vertical), it may be beneficial to utilize an offset distance OD of between 5.0 mm and 6.0 mm. Further, if it is desired to drill a 200 meter drill hole 5 at 45 degrees from the horizontal (or 45 degrees from the vertical), it may be beneficial to utilize an offset distance OD of 6.0 mm or more. Indeed, by using off-axis cam drilling tools 10 of varying offset distance OD and interchanging these tools 10 having the various offset distances OD with respect to one another, it may be possible to guide a drill bit "up" and "down" within the Earth. In other words, it may be possible to control the dip and rise of the drill bit 6 and thus the direction of the drill hole 5. For example, if it is desired that the drill hole 5 dips, a tool 10 having a smaller offset distance OD may be implemented at some point in the drill string 8 to allow the drill string 8 to dip according to the effects of gravity. If greater dip is desired, the tool 10 may be removed altogether from the drill string 8. In like manner, if it is desired that the drill hole 5 rises, a tool 10 having a larger offset distance OD may be implemented in the drill string 8 to periodically raise the drill string 8 up off the bottom surface 3 and above the centerline 1 of the drill hole 5 to combat the natural effects of gravity G on the drill string 8 and drill bit 6. Such a configuration can cause the drill bit 6 and the drill string 8 to rise within the Earth, as discussed herein. If greater rise is desired, a maximum offset OD may be used to raise the drill string 8 and cause the drill hole 5 to rise, as described herein. Thus, one of ordinary skill in the art will understand that the drill string 8 may be configured with an off-axis "cam" drilling tool 10 that achieves the desired dip and/or rise of any given drill hole 5. Further, the tool 10 may be interchanged with another tool 10 of different offset distance OD to achieve a different dip or rise at that point within the drill hole 5. Accordingly, utilization of the different embodiments of the off-axis "cam" drilling tool 10 may allow reverse circulation drill operators to control the dip and rise of the drill string 8/drill bit 6/drill hole 5. Such a configuration may allow for a method of controlling dip angle in drilling systems, including reverse circulation drilling systems.

Likewise, embodiments of the off-axis "cam" drilling tool 10 may be used to exert azimuth control over the drill bit 6 and thus the direction of the drill hole 5. Indeed, by using off-axis cam drilling tools 10 of varying offset distance OD and interchanging these tools 10 having the various offset distances OD with respect to one another, it may be possible to guide a drill bit "left" and "right" within the Earth. In other words, it may be possible to control the azimuth angle and azimuth deviation of the drill bit 6 and thus the direction of the drill hole 5. For example, by adjusting the offset distance OD on the tool 10 to have greater or lesser offset distance, the result is that the degree of azimuth control may also be adjusted accordingly. Therefore, utilization of the different embodiments of the off-axis "cam" drilling tool 10 may allow drill operators, including RC drilling operators, to control the azimuth of the drill string 8/drill bit 6/drill hole 5.

Embodiments of the off-axis "cam" drilling tool 10 may further comprise the off-axis cam section 30 having gaps or grooves 34 configured therein. The grooves 34 may be configured to run axially along the length of the off-axis cam section 30, more or less parallel with the axis 27. With grooves 34 configured in the off-axis cam section 30, individual cams 32 may be configured in the off-axis cam section 30, such that individual cams 32 alternate with grooves 34 along the width of the off-axis cam section 30, as depicted. Such a configuration may reduce the overall weight of the tool 10 and allow blow back to pass through the grooves 34 without substantially interfering with the performance of the drill string 8 and tool 10. In addition thereto, the grooves may be configured to run in a spiral configuration about the off-axis cam section 30. Such a spiral configuration may aid in the efficient passage of blow back through the tool 10 to reduce interference of blow back on the performance of the tool 10.

Figure 3A:
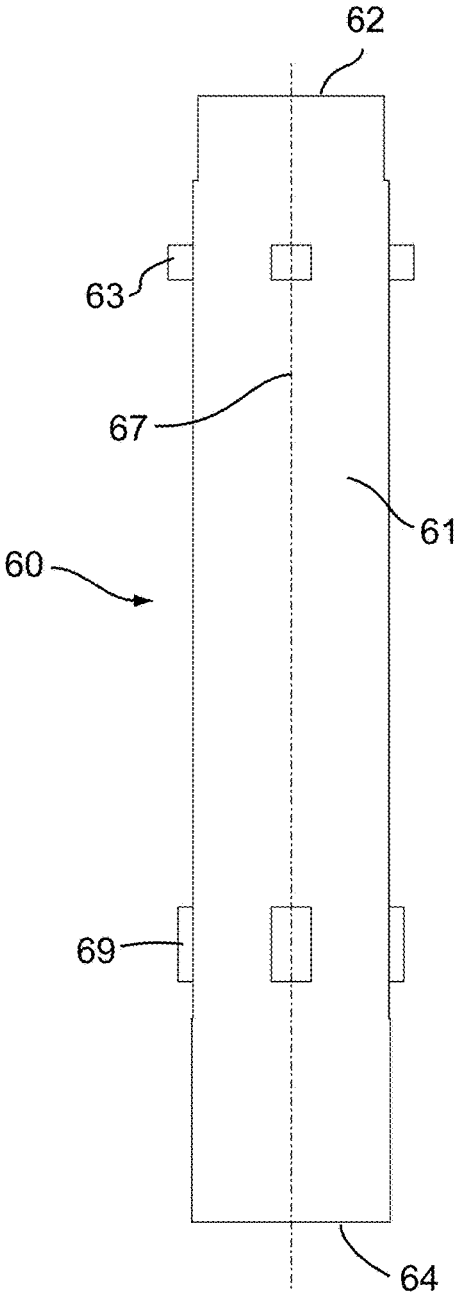
FIG. 3A is a front view of a component of the axis-offset cam drilling tool in accordance with the present disclosure.
Figure 3B:
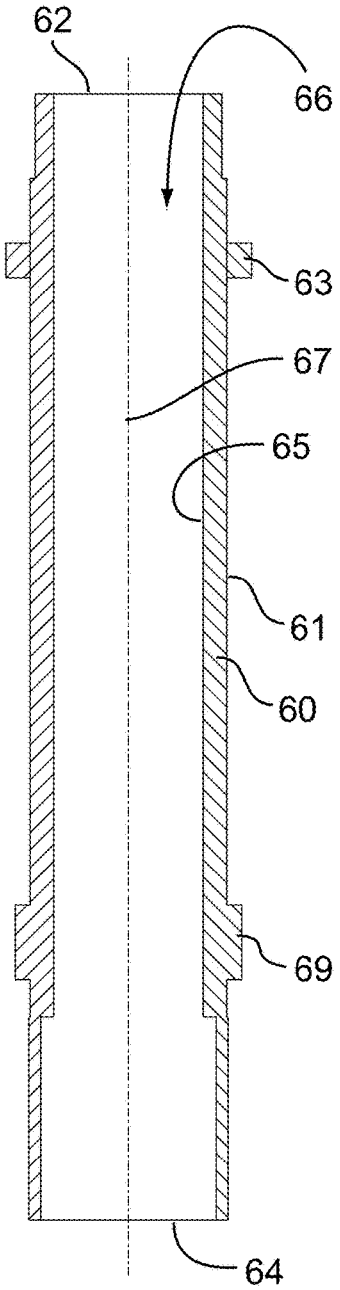
FIG. 3B is a cross-sectional view of the component of the axis-offset cam drilling tool depicted in FIG. 3A in accordance with the present disclosure.
Figure 3C:
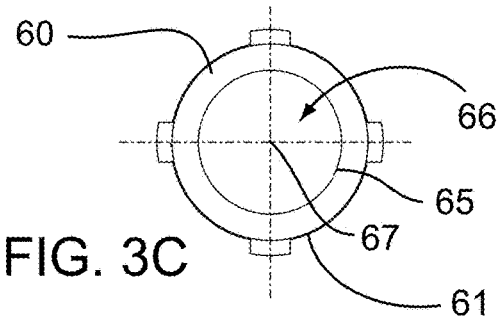
FIG. 3C is a top view of the component of the axis-offset cam drilling tool depicted in FIG. 3A in accordance with the present disclosure.

With reference now to FIGS. 3A-3C, embodiments of the off-axis "cam" drilling tool 10 may further comprise the inner tubing 60. The inner tubing 60 may be configured in a tubular circular shape to facilitate rotational drilling of a drill system, such as a RC drilling system. The inner tubing 60 may further comprise a first end 62, a second end 64, and a through bore 66 running the entire axial length of the inner tubing 60, such that the first end 62 and the second end 64 are open, as depicted in FIGS. 3B and 3C. The through bore 66 may be centered on an axis 67, such that any rotation of the inner tubing 60 may result in the inner tubing 60 rotating about the axis 67. The inner tubing 60 may further comprise spacers 63 configured on the exterior surface of the inner tubing 60 proximate the first end 62 and spacers 69 configured on the exterior surface of the inner tubing 60 proximate the second end 64. The spacers 63 and 69 may protrude outwardly off the exterior surface of the inner tubing 60. The spacers 63 may be configured to protrude outwardly a greater distance than do the spacers 69. The spacers 69 may be configured to communicate with the interior surface 25 of the outer tubing 20, whereas the spacers 63 may be configured to communicate with the interior lip 29 of the outer tubing 20.

Embodiments of the off-axis "cam" drilling tool 10 may further comprise the inner tubing 60 having an interior surface 65 that defines the through bore 66. The through bore 66 may be circular in shape, such that it may coincide with the shape and size of the hollow string rods 4 of RC drilling systems. The interior dimensions of the through bore 66, such as the diameter, may be adjusted as needed depending on the implantation of the off-axis "cam" drilling tool 10 in various drilling applications.

With reference to FIG. 5, embodiments of the off-axis "cam" drilling tool 10 may further comprise the inner tubing 60 being configured to be inserted within the through bore 26 of the outer tubing 20. Under the condition that the inner tubing 60 is positioned within the outer tubing 20, the axis 67 and the axis 27 coincide, such that they are the same axis. Once the inner tubing 60 is inserted within the trough bore 26 of the outer tubing 20, the spacers 69 slide down past the interior lip 29 and contact the interior surface 25 at a position toward the second end 24. On the other hand, the spacers 63 may function to contact and functionally engage the interior lip 29, such that the inner tubing 60 is prevented from further axially advancing down into the through bore 26. Additionally, the clip 90 may be inserted within the interior groove 23 of the outer tubing 20, such that the clip 90 is secured within the interior groove 23. At the same time, the clip 90 may be configured to contact the spacers 63 to prevent the axial retreat of the inner tubing 60 from within the through bore 26 of the outer tubing 20. As such, the inner tubing 60 is positioned within the through bore 26 of the outer tubing 20 and is structurally and functionally coupled to the outer tubing 20, such that they function as one off-axis "cam" drilling tool 10. Indeed, once properly seated, an annulus 50 is defined between the interior surface 25 of the outer tubing 20 and the exterior surface 61 of the inner tubing 60. The annulus 50 provides a pathway for a circulation medium, usually high-pressure air, to pass there through under the condition that RC drilling methods are utilized with the off-axis "cam" drilling tool 10. During RC drilling, the circulation medium may travel down a corridor in the drill rods 4 from the surface of the Earth until the circulation medium reaches the annulus 50 of the tool 10. The circulation medium may pass down through the annulus 50 to reach the drill bit 6, at which time the drilling system utilizes the circulation medium to pick up loose debris from the effects of the drill bit 6 and transports the loose debris back up through the through bore 66 of the inner tubing 60 and through the hollow drill rods 4 and back up to the surface of the Earth.

As mentioned above, the off-axis "cam" drilling tool 10 may be coupled in a drill string 8 at an advantageous position in the drill string 8. As depicted, the tool 10 is configured between the drill bit 6, the drill bit adapter 9 and/or the first drill rod 4. However, additional configurations may be adopted, such as placing the tool 10 between the first drill rod 4 and the second drill rod 4.

Figure 7:
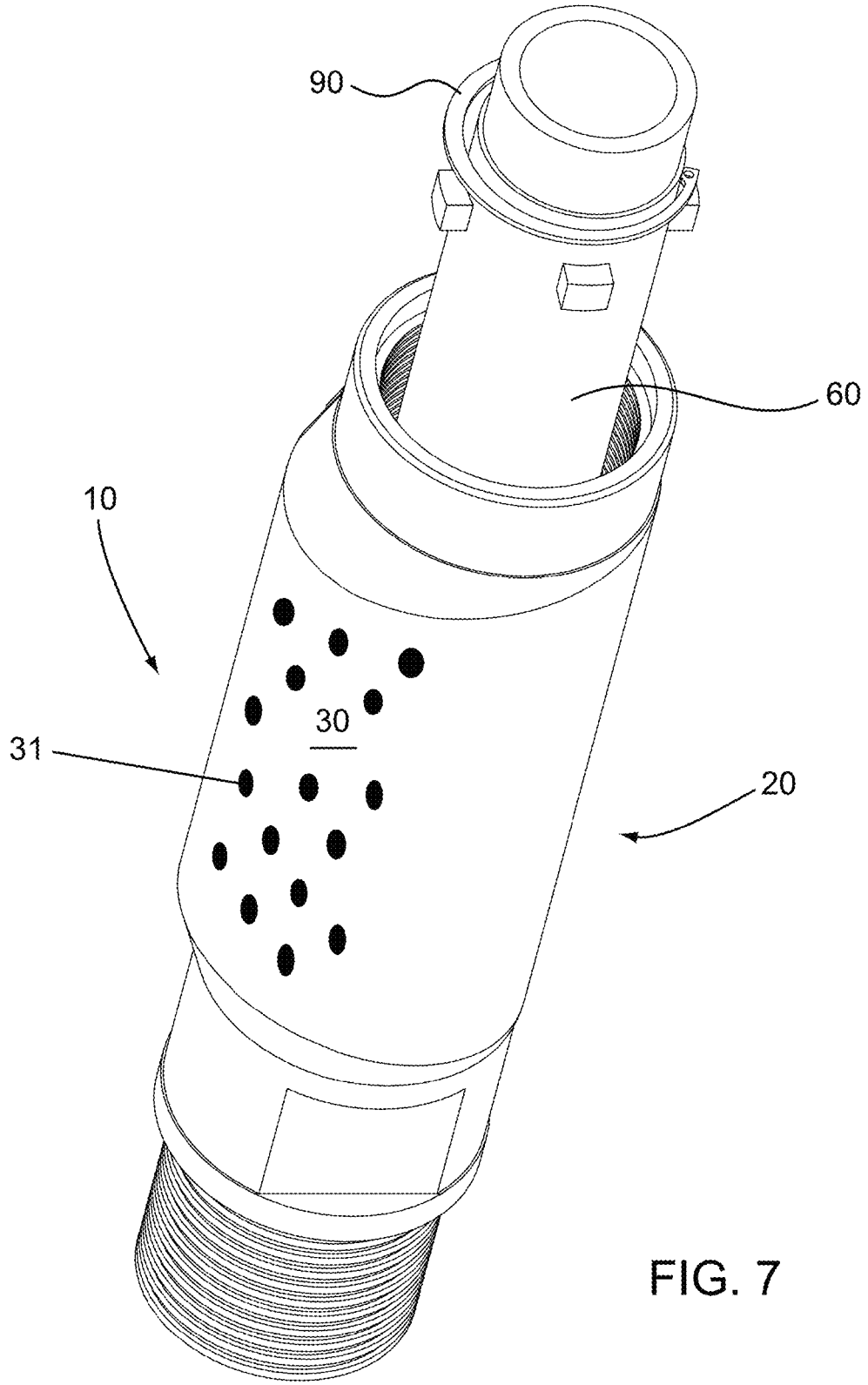
FIG. 7 is a semi-exploded perspective view of an embodiment of an axis-offset cam drilling tool in accordance with the present disclosure.

Referring to FIG. 7, embodiments of the off-axis "cam" drilling tool 10 may comprise the off-axis cam section 30 being a solid section without any gaps or grooves 34 therein. As exemplarily depicted in FIG. 7, but applicable to the off-axis cam section 30 in other embodiments of the tool 10 disclosed herein, embodiments of the off-axis "cam" drilling tool 10 may comprise the off-axis cam section 30 being comprised of tungsten carbide. The cam section 30 may be comprised entirely of tungsten carbide, such that tungsten carbide is the main material of the cam section 30 and perhaps the tool 10 or applicable parts of the tool 10 that house the cam section 30 thereon, as will be discussed herein. The cam section 30, and perhaps the tool 10 or applicable parts of the tool 10 that house the cam section 30 thereon, may be infused, manufactured, mixed or created with tungsten carbide and steel, and/or may be comprised of portions 31 thereof being made of tungsten carbide. The portions 31 may be additions, supplements, accompaniments, inserts, portions, buttons, or percentages of tungsten carbide. Under the condition that the cam section 30 is comprised in any portion of tungsten carbide, the cam section 30 may be more abrasion resistant and may also withstand higher temperatures than standard high speed steel tools. The tungsten carbide may be comprised of cemented carbide, hard-metal or tungsten-carbide cobalt, and, for example, may be a metal matrix composite where tungsten carbide particles are the aggregate and metallic cobalt serves as the matrix. The portions 31 may be arranged, organized, or otherwise placed in a pattern or at random, as needed, on the cam section 30, such that the portions 31 may be in a position to reduce the wear and tear that the cam section 30 may be susceptible to during drilling operations. In this way, the tungsten carbide, for example, the portions 31, can reduce the premature wear of the cam section 30.

Figure 8C:
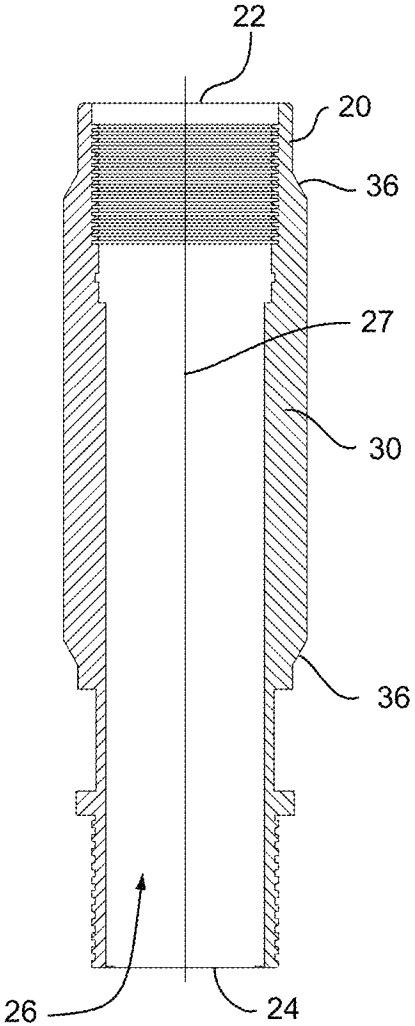
FIG. 8C is a cross-sectional view of the component of the axis-offset cam drilling tool depicted in FIG. 8A in accordance with the present disclosure.
Figure 8B:
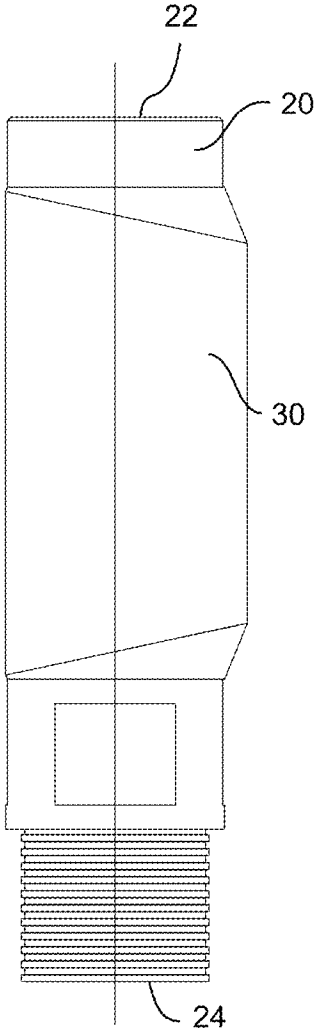
FIG. 8B is a side view of a component of the axis-offset cam drilling tool depicted in FIG. 8A in accordance with the present disclosure.
Figure 8A:
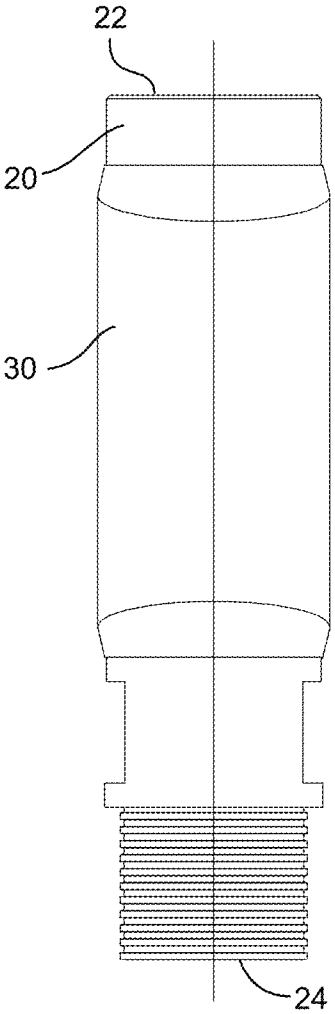
FIG. 8A is a front view of a component of the axis-offset cam drilling tool in accordance with the present disclosure.

Referring to FIGS. 8A-8C, embodiments of the off-axis "cam" drilling tool 10 may comprise the off-axis cam section 30 being a solid section without any grooves 34 therein. A solid off-axis cam section 30 without any grooves 34 therein may be advantageous to the longevity of the off-axis "cam" drilling tool 10, as the grooves 34 and individual cams 32 of other embodiments may be subjected to additional wear and tear.

Figure 9:
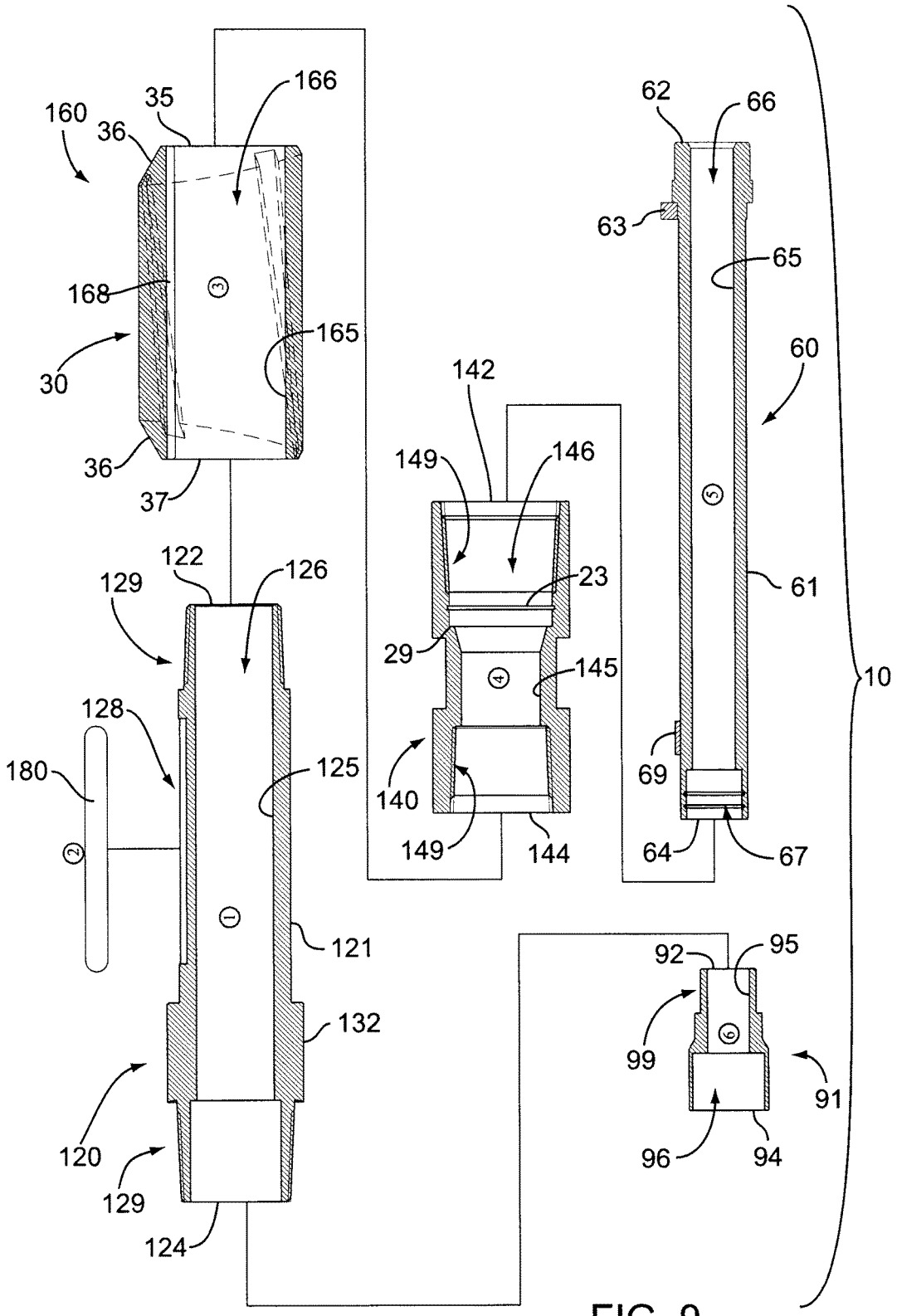
FIG. 9 is an exploded cross-sectional view of an embodiment of the axis-offset cam drilling tool in accordance with the present disclosure.
Figure 10:
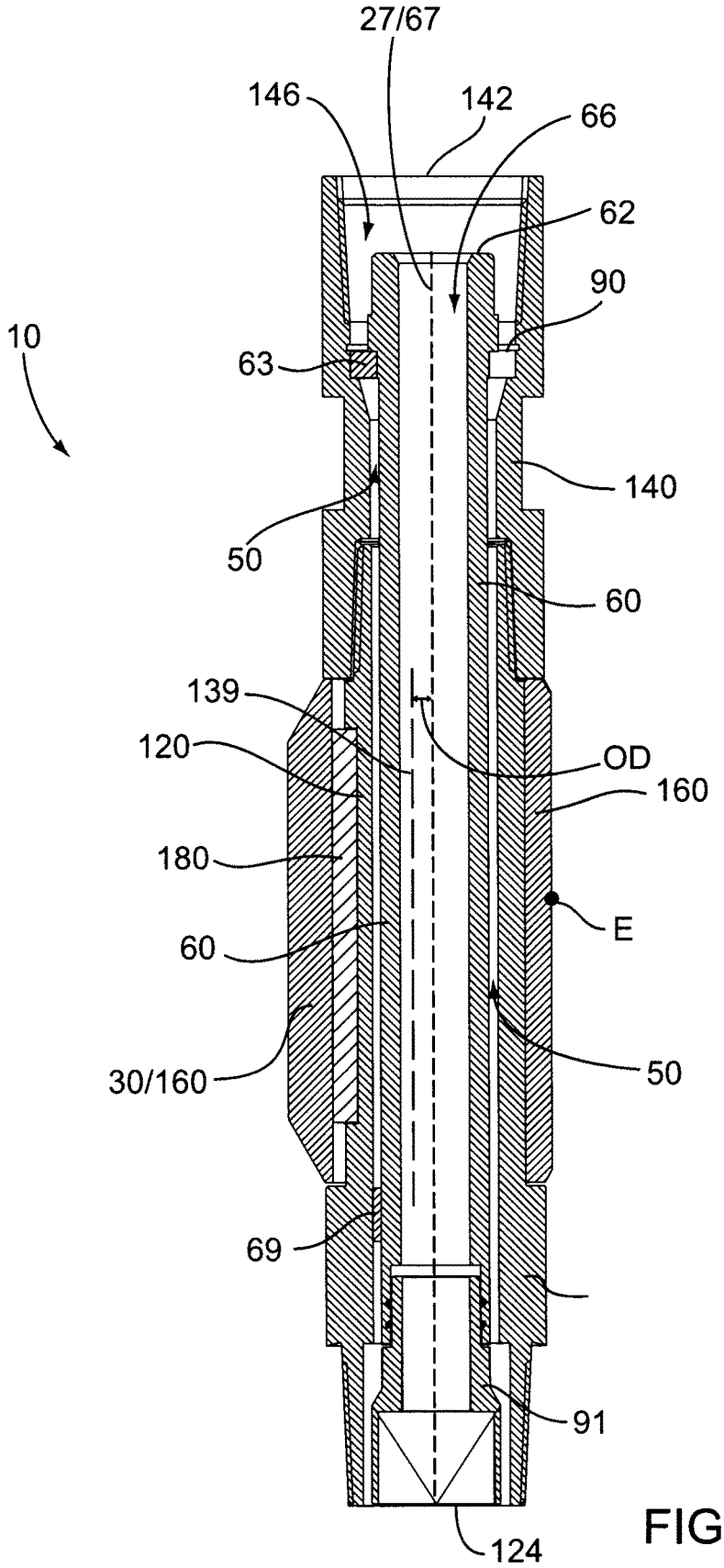
FIG. 10 is a cross-sectional view of the embodiment of the axis-offset cam drilling tool depicted in FIG. 9 in accordance with the present disclosure.

Referring now to FIGS. 9 and 10, embodiments of the off-axis "cam drilling tool 10 may comprise the outer tubing 20 being comprised of a first body 120 and a second body 140, and the off-axis cam section 30 being configured on a sleeve 160 that may be configured to be able to be removed from the off-axis "cam drilling tool 10. The first body 120 and the second body 140 may be configured to releasably couple to one another. The sleeve 160 may be configured to slide over and onto a portion of the first body 120, and the second body 140 may be coupled to the first body 120 to help secure the sleeve 160 on the first body 120.

The sleeve 160 may comprise the cam section 30 that has the first end 35 and the second end 37, with the respective tapered sections 36 being configured proximate the first end 35 and the second end 37. The cam section 30 on the sleeve 160 may be a cylindrical section, similar to the cylindrical section described above with respect to the cam section 30 on the outer tubing 20. The off-axis cam section 30 on the sleeve 160 may be a cylinder having a substantially constant circular diameter. However, the off-axis cam section 30 on the sleeve 160 may be configured to have an axis 139 that, although is substantially parallel to the axis 27/67 of the first and second bodies 120 and 140, is axially offset thereto by the offset distance OD, which is one half the desired operating offset distance DOOD.

For example, the cam section 30 on the sleeve 160 may have portions thereof that have an outer diameter that is larger than the outer diameter of the first and second bodies 120 and 140, which may also have cylindrical sections, or at least have portions thereof that are cylindrical. In other words, the first and second bodies 120 and 140 may have cylindrical sections that have a first diameter and the off-axis cam section 30 on the sleeve 160 may have cylindrical sections that have a second diameter that are larger than the first diameter. In some embodiments, the first and second diameters may be internally tangent to one another on one side of the off-axis "cam" drilling tool 10, with an edge of the diameter of the first and second bodies 120 and 140 being proximate the edge of the diameter of the cam section 30 on the sleeve 160, at, for example and not in any way limiting, point E, as shown in FIG. 10, and yet the diameters of the first and second bodies 120 and 140 being completely within the diameter of the cam section 30 on the sleeve 160. As a result, the second diameter of the cam section 30 that is larger than the diameter of the first and second bodies 120 and 140 causes the cam section 30 on the sleeve to protrude off the exterior surface of the off-axis "cam" drilling tool 10 with respect to the first and second bodies 120 and 140 a desired operating offset distance DOOD. This desired operating offset distance DOOD can be manipulated and determined by the user as needed to perform the desired drilling operation. The desired operating offset distance DOOD is usually two times the offset distance OD described herein.

For example, the axis 139 of the off-axis cam section 30 on the sleeve 160 and the axis 27/67 can be separated by a distance OD (i.e., offset distance) in one direction. This offset distance OD between the axis 27/67 of the first and second bodies 120 and 140 and the axis 139 of the cylindrical off-axis cam section 30 on the sleeve 160 results in the off-axis cam section 30 on the sleeve 160 creating a "cam-like" protrusion or cam body on at least one side of the first and second bodies 120 and 140. For example, as depicted in FIG. 10, the off-axis cam section 30 on the sleeve 160 is offset with respect to the axis 27/67 by the distance OD, such that the off-axis cam section 30 protrudes from the outer surface of the first and second bodies 120 and 140 the desired operating offset distance DOOD. The off-axis cam section 30 on the sleeve 160 may be configured to function and operate in the same, or similar, way to the function and operation of the cam section 30 on the outer tubing 20, except that the off-axis cam section 30 on the sleeve 160 may be removable from the first body 120 by removal of the sleeve 160 from the first body 120, whereas the cam section 30 on the outer tubing 20 is fixedly coupled thereto, as described above.

Figure 11:
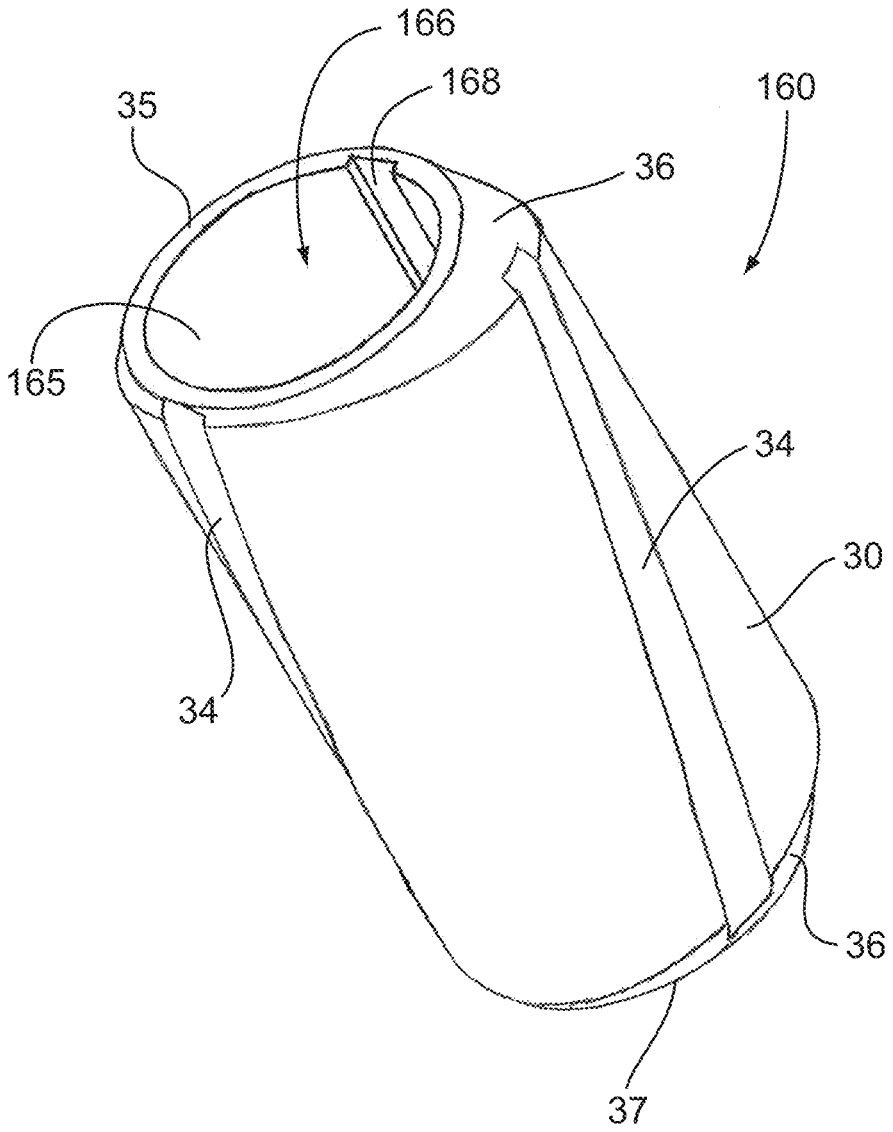
FIG. 11 is a perspective view of a component of the embodiment of the axis-offset cam drilling tool depicted in FIGS. 9 and 10 in accordance with the present disclosure.

Referring now to FIGS. 9 and 11, the sleeve 160 may further comprise a bore 166 that runs the entire length of the sleeve 160 from the first end 35 to the second end 37. The bore 166 may have an interior surface 165. The interior surface 165 may define thereon a channel 168 that may be an indention in the interior surface 165. The channel 168 may be configured to functionally and structurally communicate with a key 180, to be described. The bore 166 may be configured to have a diameter that is sized to functionally communicate with a portion of the exterior surface of the first body 120. The sleeve 160 may further comprise a groove 34 in an exterior surface thereof. As depicted, the groove 34 may be angled with respect to the axis 139 of the bore 166. However, in the alternative, the cam section 30 on the sleeve 160 may comprise the groove 34 being a plurality of grooves 34 or the groove 34 (or plurality of grooves 34) being aligned in parallel with the axis 139.

Referring now to FIGS. 9 and 10, the first body 120 may be configured in a tubular circular shape to facilitate rotational drilling of a drill system, such as a RC drilling system. The first body 120 may be a tubular body. The first body 120, or first tubular body, may have portions thereof that are non-cylindrical and portions thereof that are cylindrical and have an outer diameter. The first body 120 may further comprise a first end 122, a second end 124, and a through bore 126 running the entire axial length of the first body 120, such that the first end 122 and the second end 124 are open, as depicted in FIGS. 9 and 10. The through bore 126 may be centered on the axis 27, such that any rotation of the first body 120 may result in the first body 120 rotating about the axis 27. The first body 120 may further comprise engagement portions 129, such as threaded sections, on the interior or exterior of the second end 124, such that the off-axis "cam" drilling tool 10, by way of the first body 120, may be releasably and repeatedly coupled to one or more of a drill bit 6 or other component of a drill string 8. The engagement portions 129 on the interior or exterior of the first end 122 may be configured to functionally engage corresponding engagement portions 149 on the second body 140 to functionally engage the first body 120 and the second body 140 together as a single unit.

Embodiments of the off-axis "cam" drilling tool 10 may further comprise the first body 120 having an interior surface 125 that is defined by the through bore 126. The through bore 126 may be circular in shape, such that it may coincide with the shape and size of the hollow string rods 4 of RC drilling systems. The interior dimensions of the through bore 126, such as the diameter, may be adjusted as needed depending on the implantation of the off-axis "cam" drilling tool 10 in various drilling applications. The first body 120 may have an exterior surface 121. Portions of the exterior surface 121 may define thereon an indention 128 and an exterior ridge 132. The indention 128 may be configured to have a length that is aligned along the length of the first body 120. The indention 128 may be configured to receive therein a key 180. The exterior ridge 132 may be a raised portion that rises up off the surface of the exterior surface 121. The exterior ridge 132 may be configured to contact the second end 37 of the cam section 30 on the sleeve 160, under the condition the sleeve 160 is guided onto the first body 120. For example, the first end 122 of the first body 120 may be inserted into the bore 166 such that the sleeve 160 may be axially advanced along the length of the exterior surface 121 of the first body 120 until the second end 37 functionally engages the exterior ridge 132.

Further, under the condition the sleeve 160 is inserted onto or around the first body 120, the key 180 may be inserted and positioned between the sleeve 160 and the first body 120 to prevent the movement of the sleeve 160 with respect to the first body 120. For example, the key 180 may be configured to be inserted within and functionally engage both the indention 128 in the exterior surface 121 of the first body 120 and the channel 168 on the interior surface 165 of the sleeve 160. In this way, with the sleeve 160 inserted over the first body 120, with the key 180 positioned functionally therebetween, the key 180 may prevent the relative movement of the sleeve 160 and the first body 120 with respect to one another. In other words, the structure and function of the key 180 with respect to the channel 168 on the sleeve 160 may functionally fasten, couple, link, join, or otherwise connect the sleeve 160 to the first body 120. The shape and size of the indention 128, the channel 168, and the key 180 should be configured such that the key 180 may engage both the channel 168 and the indention 128 to prevent the relative movement between the sleeve 160 and the first body 120. The key 180 may receive wear and tear under normal operation and thus by having the key 180 be a stand-alone component, the key 180 may be easily replaced, refurbished, or otherwise fixed as needed.

Embodiments of the off-axis "cam" drilling tool 10 may comprise the key 180 being an integral component of the first body 120, such that the key 180 forms part and portion of the first body 120, but yet functions similarly to the description provided above with regard to the stand-along key 180 in that the key 180 as part of the first body 120 nevertheless functionally communicates with the channel 168 on the sleeve 160. Similarly, embodiments of the off-axis "cam" drilling tool 10 may comprise the key 180 being an integral component of the sleeve 160, such that the key 180 resides within the bore 166 and forms part and portion of the interior surface 165 of the sleeve 160, but yet functions similarly to the description provided above with regard to the stand-along key 180 in that the key 180 as part of the sleeve 160 nevertheless functionally communicates with the indention 128 on the first body 120. In this case, the indention 128 may need to be configured to be open to the first end 122 to permit insertion of the key 180 into the indention 128 as the sleeve 160 is inserted onto the first body 120.

Embodiments of the off-axis "cam" drilling tool 10 may further comprise a second body 140 that may be configured to functionally couple to the first body 120. The second body 140 may be configured in a tubular circular shape to facilitate rotational drilling of a drill system, such as a RC drilling system. The second body 140 may be a tubular body. The second body 140, or second tubular body, may have portions thereof that are non-cylindrical and portions thereof that are cylindrical and have an outer diameter. The second body 140 may be shaped and sized similarly to the first body 120. The second body 140 may have an outer diameter of its cylindrical portions that is substantially similar to the outer diameter of the cylindrical portions of the first body 120. The second body 140 may comprise a first end 142, a second end 144, and a through bore 146 running the entire axial length of the second body 140, such that the first end 142 and the second end 144 are open, as depicted in FIGS. 9 and 10. The through bore 146 may be centered on the axis 27/67, such that any rotation of the second body 140 may result in the second body 140 rotating about the axis 27/67. The through bore 146 may define an interior surface 145 of the second body 140. The second body 140 may further comprise engagement portions 149, such as threaded sections on the interior or exterior of the first end 142, such that the off-axis "cam" drilling tool 10, by way of the second body 140, may be releasably and repeatedly coupled to one or more of a drill rod 4 or other component of a drill string 8. The engagement portions 149 on the interior or exterior of the second end 144 of the second body 140 may be configured to functionally engage corresponding engagement portions 129 on the first end 122 on the first body 120 to functionally couple the first body 120 and the second body 140 together as a single unit. As depicted in FIGS. 9 and 10, the engagement portions 129 are configured on an exterior surface of the first and second ends 122 and 124 of the first body 120, whereas, the engagement portions 149 are configured on an interior surface of the first and second ends 142 and 144 of the second body 140. Alternatively, the relative position of the engagement portions 129 and 149 on first and second body 120 and 140, respectively, may be altered, or reversed, so long as first and second body 120 and 140 may be functionally coupled together.

Together, the first body 120 and the second body 140 may comprise the outer tubing 20, absent the cam section 30 on the outer tubing 20. However, by placing the sleeve 160, having the cam section 30 thereon, on the first body 120, as described, the first body 120, the second body 140, and the sleeve 160 may together comprise the outer tubing 20 as described above with respect to embodiments of the off-axis "cam" drilling tool 10.

Embodiments of the off-axis "cam" drilling tool 10 may further comprise the second body 140 having the interior lip 29 and the interior grove 23, as described above with respect to outer tubing 20, on the surface of the through bore 146. The interior lip 29 may be configured to receive and communicate with the inner tubing 60, as described above. Further, the interior groove 23 may be configured to receive the c-ring clip 90 therein, which is depicted in FIG. 10. The clip 90 may be configured to be inserted into and sit within the interior groove 23 and communicate with not only the second body 140 but also the inner tubing 60, such that the clip 90 may prevent axial retreat of the inner tubing 60 with respect to the second body 140 once the second body 140 and the inner tubing 60 have been positioned relative to one another and the clip 90 has been positioned within the groove 23, as depicted in FIG. 10 and as described herein.

With reference to FIG. 10, embodiments of the off-axis "cam" drilling tool 10 may further comprise the inner tubing 60 being configured to be inserted within the combined bores 126 and 146 of the first and second body 120 and 140, respectively. Once coupled together, combined bores 126 and 146 may function similarly to that of through bore 26 of the outer tubing 20, as described above. For example, under the condition that the inner tubing 60 is positioned within first and second body 120 and 140, the axis 67 of the inner tubing 60 and axes of the first and second body 120 and 140 coincide, such that they are the same axis. The axes of the first and second body 120 and 140 are substantially the same as the axis 27 of the outer tubing 20, described above. Once the inner tubing 60 is inserted within the first and second body 120 and 140, the spacers 69 may slide down past the interior lip 29 of the second body 140 and contact the interior surface 125 of the first body 120 at a position toward the second end 124. On the other hand, the spacers 63 may function to contact and functionally engage the interior lip 29 of the second body 140, such that the inner tubing 60 is prevented from further axially advancing down into the through bores 126 and 146. Additionally, as mentioned above, the clip 90 may be inserted within the interior groove 23 of the second body 140, such that the clip 90 is secured within the interior groove 23. At the same time, the clip 90 may be configured to contact the spacers 63 to prevent the axial retreat of the inner tubing 60 from within the through bores 126 and 146 of the first and second body 120 and 140, respectively. As such, the inner tubing 60 is positioned within the 126 and 146 of the first and second body 120 and 140, respectively, and is structurally and functionally coupled to the first and second body 120 and 140, such that they function as one off-axis "cam" drilling tool 10. Indeed, once properly seated, an annulus 50 is defined between the combined interior surfaces 125 and 145 of the first and second body 120 and 140, respectively, and the exterior surface 61 of the inner tubing 60. The annulus 50 provides a pathway for a circulation medium, usually high-pressure air, to pass therethrough under the condition that RC drilling methods are utilized with the off-axis "cam" drilling tool 10. During RC drilling, the circulation medium may travel down a corridor in the drill rods 4 from the surface of the Earth until the circulation medium reaches the annulus 50 of the tool 10. The circulation medium may pass down through the annulus 50 to reach the drill bit 6, at which time the drilling system utilizes the circulation medium to pick up loose debris from the effects of the drill bit 6 and transports the loose debris back up through the through bore 66 of the inner tubing 60 and through the hollow drill rods 4 and back up to the surface of the Earth.

With reference to FIGS. 9 and 10, embodiments of the off-axis "cam" drilling tool 10 may further comprise an inner tubing adapter 91. The adapter 91 may have a first end 92, a second end 94 and a through bore 96 running therethrough from the first end 92 to the second end 94. The adapter 91 may have an interior surface 95 defined by the through bore 96. The through bore 96 may communicate with the through bore 66 of the inner tubing 60, such that once the adapter 91 is coupled to the inner tubing 60, the through bore 66 and the through bore 96 may comprise a single bore. The adapter 91 may comprise engagement portions 99 on the first end 92. The engagement portions 99 may be positioned on an exterior of the adapter 90 so as to communicate and engage the surface features 67 on the interior of the inner tubing 60. In this way, the adapter 91 may functionally couple to and engage the second end 64 of the inner tubing 60. The adapter 91 may also be configured to functionally engage the drill bit 6 or the drill bit adapter (sub) 9, such that the tool 10 may be positioned between the drill bit 6, drill bit adapter (sub) 9 and the remaining portions of the drill string 8, such as the drill rods 4 that lead up to the surface of the Earth.

Figure 12:
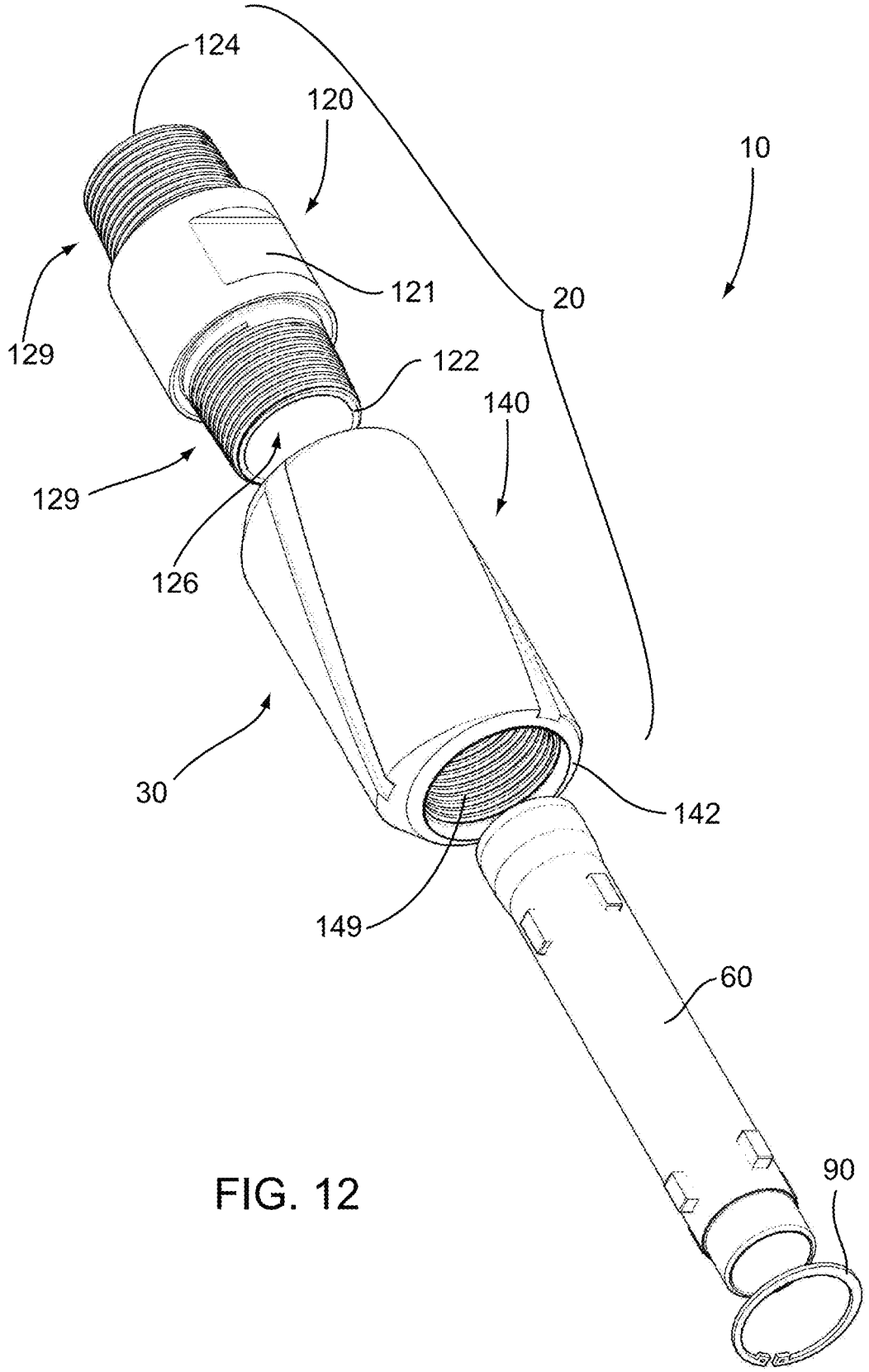
FIG. 12 is an exploded perspective view an embodiment of the axis-offset cam drilling tool in accordance with the present disclosure.
Figure 13:
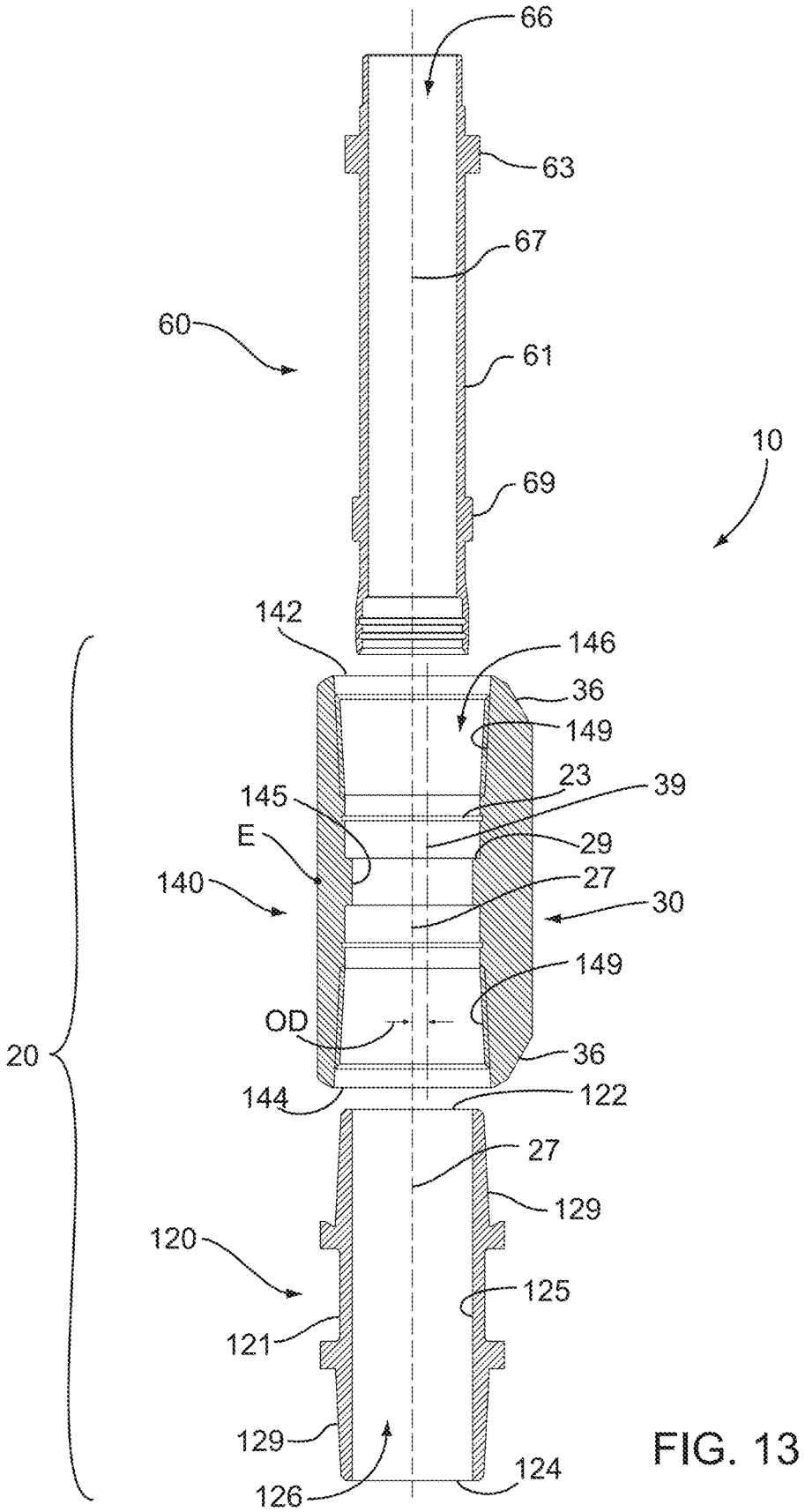
FIG. 13 is an exploded cross-sectional side view of the embodiment of the axis-offset cam drilling tool depicted in FIG. 12, in accordance with the present disclosure.

With reference to FIGS. 12 and 13, with component parts of the tool 10 comprising the first body 120, the second body 140, the sleeve 160, the inner tubing 60, the key 180, and the adapter 91, the tool 10 may be adaptable and interchangeable for various needs, for various-sized holes or for additional drill string 8 control. For example, by having the sleeve 160 be removable from the tool 10, when the cam section 30 is worn down, needs to be replaced, or a different offset distance OD needs to be utilized in the drill string 8, the sleeve 160 may simply be removed and a new sleeve 160 may be inserted thereon without having to replace other components of the tool 10. This saves in manufacturing and replacement costs. Moreover, when a different offset distance OD needs to be utilized to provide directional control of the drill bit 6/drill string 8, the sleeve 160 may be removed and a new sleeve 160 having a cam section 30 with a different offset distance OD may be easily inserted thereon. For example, the first and second body 120 and 140 may be decoupled from one another, the sleeve 160 may be slid off the first body 120, a new sleeve 160 may be inserted on the first body 120, and the first and second body 120 and 140 may be coupled back together having the new sleeve 160 positioned thereon. In this way, the other components of the drill string 8, such as the drill bit 6 or the drill rods 4 need not be detached from the tool 10 while the sleeve 160 is replaced. Accordingly, the tool 10 may be configured to have a set of sleeves 160, each sleeve 160 in the set having a cam section 30 with a different offset distance OD or with a different configuration of grooves 34, or both. Needless to say, the adaptability of the tool 10 is greatly increased by the configuration of the sleeve 160, and other associated component parts described herein, of the tool 10.

Referring now to FIGS. 12 and 13, embodiments of the off-axis "cam" drilling tool 10 may comprise the outer tubing 20 being comprised of a first body 120 and a second body 140, and the off-axis cam section 30 being configured on a portion of the second body 140. Indeed, in some embodiments of the off-axis "cam" drilling tool 10 the off-axis cam section 30 may be formed integrally with the second body 140. The first body 120 and the second body 140 may be configured to releasably and repeatedly couple to one another.

Embodiments of the tool 10 may comprise the first body 120 being configured in a tubular circular shape to facilitate rotational drilling of a drill system, such as a RC drilling system. The first body 120 may be a tubular body. The first body 120, or tubular body, may have portions thereof that are non-cylindrical and portions thereof that are cylindrical and have an outer diameter. The first body 120 may further comprise a first end 122, a second end 124, and a through bore 126 running the entire axial length of the first body 120, such that the first end 122 and the second end 124 are open, as depicted in FIGS. 12 and 13. The through bore 126 may be centered on the axis 27, such that any rotation of the first body 120 may result in the first body 120 rotating about the axis 27. The first body 120 may further comprise engagement portions 129, such as threaded sections, on the interior or exterior of the second end 124, such that the off-axis "cam" drilling tool 10, by way of the first body 120, may be releasably and repeatedly coupled to one or more of a drill bit 6 or other component of a drill string 8. Similarly configured engagement portions 129 on the interior or exterior of the first end 122 may be configured to functionally engage corresponding engagement portions 149 on the second body 140 to functionally engage the first body 120 and the second body 140 together as a single unit. Engagement portions 129 may be internal or external threaded regions.

Embodiments of the off-axis "cam" drilling tool 10 may further comprise the first body 120 having an interior surface 125 that is defined by the through bore 126. The through bore 126 may be circular in shape, such that it may coincide with, or at least be complimentary of, the shape and size of the interior diameter of the hollow string rods 4 of RC drilling systems. The interior dimensions of the through bore 126, such as the diameter, may be adjusted as needed depending on the implantation of the off-axis "cam" drilling tool 10 in various drilling applications. The first body 120 may have an exterior surface 121. The exterior surface 121 may comprise indentions 21, which may define flat surfaces, to facilitate the grip of fastening tools, such as a wrench, that may be utilized to tighten the tool 10 in the drill string 8.

Embodiments of the off-axis "cam" drilling tool 10 may further comprise a second body 140 being configured in a tubular circular shape to facilitate rotational drilling of a drill system, such as a RC drilling system. The second body 140 may be a tubular body. The second body 140, or tubular body, may have portions thereof that are non-cylindrical and portions thereof that are cylindrical and have an outer diameter. The second body 140 may be configured to functionally couple to the first body 120. The second body 140 may comprise a first end 142, a second end 144, and a through bore 146 running the entire axial length of the second body 140, such that the first end 142 and the second end 144 are open, as depicted in FIGS. 12 and 13. The through bore 146 may be centered on the axis 27/67, such that any rotation of the second body 140 may result in the second body 140 rotating about the axis 27/67. The through bore 146 may define an interior surface 145 of the second body 140. The second body 140 may further comprise engagement portions 149, such as threaded sections at or near the interior or exterior of the first end 142, such that the off-axis "cam" drilling tool 10, by way of the second body 140, may be releasably and repeatedly coupled to one or more of a drill rod 4 or other component of a drill string 8. Similar engagement portions 149 at or near the interior or exterior of the second end 144 of the second body 140 may be configured to functionally engage corresponding engagement portions 129 at or near the first end 122 on the first body 120 to functionally couple the first body 120 and the second body 140 together as a single unit. As depicted in FIG. 12, the engagement portions 129 are configured on an exterior surface of the first and second ends 122 and 124 of the first body 120, whereas, the engagement portions 149 are configured on an interior surface of the first and second ends 142 and 144 of the second body 140. Alternatively, the relative position of the engagement portions 129 and 149 on first and second body 120 and 140, respectively, may be altered, or reversed, so long as first and second body 120 and 140 may be functionally coupled together.

Figure 14:
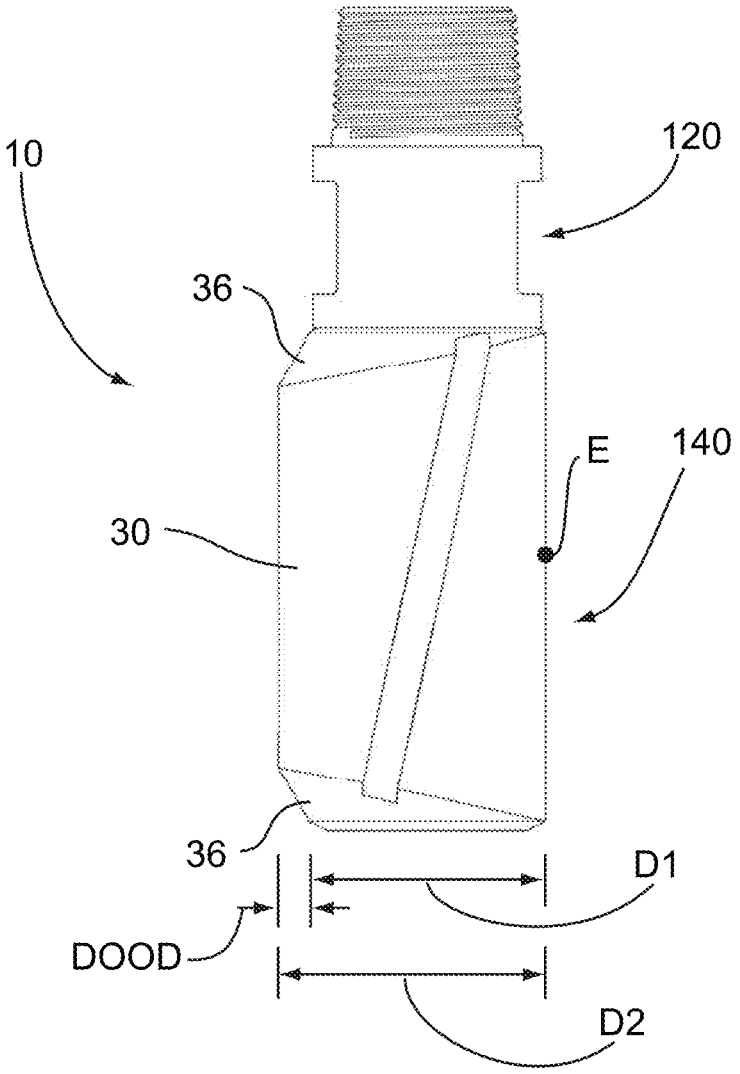
FIG. 14 is a side view of the embodiment of the axis-offset cam drilling tool depicted in FIG. 12, in accordance with the present disclosure.
Figure 15:
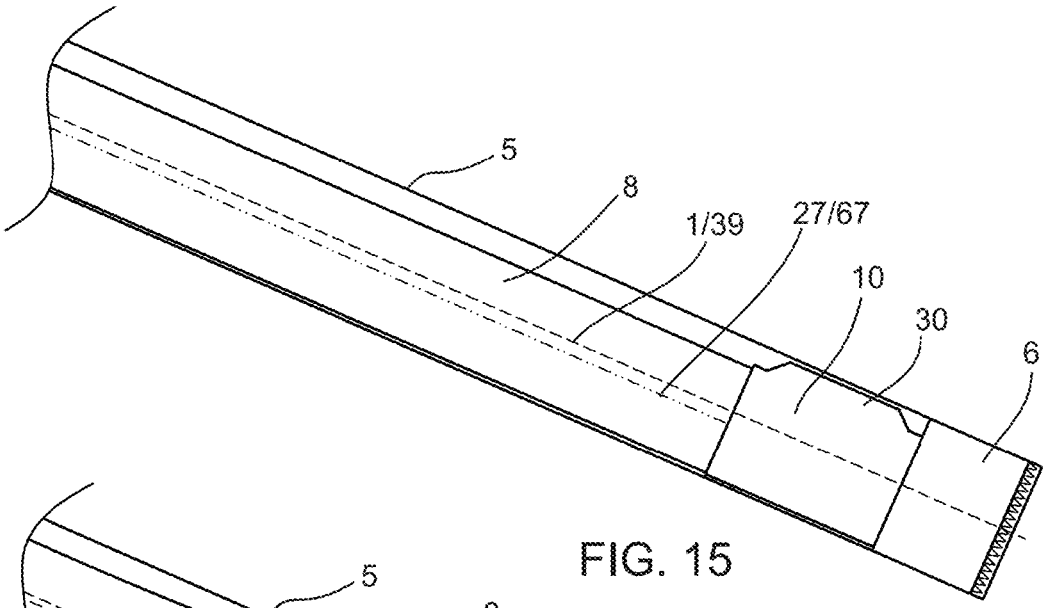
FIG. 15 is a side view of an embodiment of the axis-offset cam drilling tool within a drill hole, in accordance with the present disclosure.

As coupled together the first body 120 and the second body 140 may comprise the outer tubing 20 as described above with respect to other embodiments of the off-axis "cam" drilling tool 10. For example, embodiments of the off-axis "cam" drilling tool may comprise the second body 140 having coupled thereto the cam section 30. Alternatively, for example, the second body 140 may have the cam section 30 formed integrally therewith. As depicted in FIG. 13, the off-axis cam section 30 may be a cylindrical section coupled with, or incorporated onto, the second body 140, the cam section 30 having a substantially constant circular diameter along its axial length. The outer diameter of the cylindrical portions of the cam section 30 may be larger than the outer diameter of the cylindrical portions of the second body 140. And, the outer diameter of the cylindrical portions of the second body 140 may be substantially the same as the outer diameter of the cylindrical portions of the first body 120 to which the second body 140 may be releasably coupled. As depicted in FIG. 14, the outer diameter of the cylindrical portions of the cam section 30 may be a second diameter D2 and the outer diameter of the cylindrical portions of the second body 140 and the first body 120 may be a first diameter D1.

And, in some embodiments, the first and second diameters may be internally tangent to one another on one side of the off-axis "cam" drilling tool 10, with an edge of the outer diameter of the first and second bodies 120 and 140 being proximate the edge of the outer diameter of the cam section 30, at, for example and not in any way limiting, point E, as shown in FIGS. 13 and 14, and yet outer diameter of the first and second bodies 120 and 140 being substantially, if not completely, within the outer diameter of the cam section 30. As a result, the second diameter of the cam section 30 that is larger than the diameter of the first and second bodies 120 and 140 causes the cam section 30 to protrude off the exterior surface of the first and second bodies 120 and 140 a desired operating offset distance DOOD. This desired operating offset distance DOOD can be manipulated and determined by the user as needed to perform the desired drilling operation. The desired operating offset distance DOOD is usually two times the offset distance OD described herein.

In accordance with the above, the off-axis cam section 30 on the second body 140 may be configured to have an axis 39 that, although is substantially parallel to the axis 27 of the first and second bodies 120 and 140, is axially offset thereto because of the differing diameters. For example, the axis 39 of the off-axis cam section 30 and the axis 27 can be separated by the distance OD (i.e., offset distance) in one direction. This offset distance OD between the axis 27 of the first and second bodies 120 and 140 and the axis 39 of the cylindrical off-axis cam section 30 results in the off-axis cam section 30 protruding off of at least one side of the second body 140 with respect to the first and second bodies 120 and 140 to create an offset section in the same one direction. The offset distance OD may be substantially equal to one half the difference between the diameter of the cam section 30 and the diameter of the outer tubing 20, or, in other words, the difference between the first and second diameters. For example, the axis 39 of the off-axis cam section 30 is offset with respect to the axis 27, such that the offset section of the off-axis cam section 30 protrudes from the outer surface of the off-axis "cam" drilling tool 10 with respect to the first and second bodies 120 and 140 a distance of 2*OD (two times the offset distance OD). The offset distance OD will usually be one half the desired operating offset distance DOOD, or the distance between the first and second diameters.

Stated again, the cam section 30 on the second body 140 may have an axis 39 that is substantially parallel to the axis 27 of the second body 140 but is axially offset thereto by an offset distance OD. This offset distance OD between the axis 27 of the second body 140 and the axis 39 of the cylindrical off-axis cam section 30 results in the off-axis cam section 30 creating a "cam-like" protrusion, or an offset section, on at least one side of the second body 140 that is offset from the second body 140, and thus offset from the outer tubing 20 comprising the first and second bodies 120 and 140, a desired operating offset distance DOOD that is double the offset distance OD. For example, and not by way of limitation, if the desired operating offset distance DOOD is 6 mm, then the offset distance OD between axis 39 and axis 27 should be approximately 3 mm, and vice versa.

Embodiments of the off-axis "cam" drilling tool 10 may further comprise the off-axis cam section 30 on the second body 140 having a diameter that may be slightly smaller than the diameter of the drill bit 6, but not by much. For example, in some embodiments, the diameter of the off-axis cam section 30 may be only 1.5 mm to 2 mm (or about 1/16 of an inch) smaller than the diameter of the drill bit 6. This provides that the off-axis cam section 30 may reside within the drill hole 5 and yet rotate within the drill hole 5 as the drill rods 4 provide rotational motion to the drill string 8 such that the drill string 8 rotates within the drill hole 5. Moreover, because the diameter of the off-axis cam section 30 is more or less the same as the diameter of the drill bit 6, the off-axis cam section 30 does not "sag" or "dip" within the drill hole 5, which likewise prevents the tool 10 from "sagging" or "dipping" within the drill hole 5. In other words, the effects of gravity G on the tool 10 are minimized, or even eliminated, by the circular diameter of the off-axis cam section 30 being substantially the same as the circular diameter of the drill bit 6 or drill hole 5. In some embodiments, the axis 39 of the off-axis cam section 30 may be substantially axially aligned with the axis of the drill bit 6. The beneficial effects of such a configuration will be described in greater detail herein.

Embodiments of the off-axis "cam" drilling tool 10 may further comprise the off-axis cam section 30 on the second body 140 having an axial length that is aligned in parallel to the axial length of the second body 140. The length of the off-axis cam section 30 may run axially along a portion of the length of the second body 140. Alternatively, the length of the off-axis cam section 30 may be configured to run along the entire length of the second body 140. As depicted in FIGS. 13 and 14, the off-axis cam section 30 may be configured on a majority of the length of the second body 140. The off-axis cam section 30 may have a first end 35 and a second end 37. Embodiments of the off-axis cam section 30 may comprise each of the first and second ends 35 and 37 having a tapered section 36 that is angled with respect to the outer surface of the second body 140. The tapered sections 36 may make it easier for the off-axis "cam" drilling tool 10 to operate within the drill hole 5 under normal operating conditions, and in particular while the off-axis "cam" drilling tool 10 is rotating with the drill string 8. The tapered sections 36 may allow the off-axis "cam" drilling tool 10 to avoid hanging up or snagging on the drill hole 5 as the drill string 8, and thus the off-axis "cam" drilling tool 10, move axially and radially within the drill hole 5.

Figure 16:
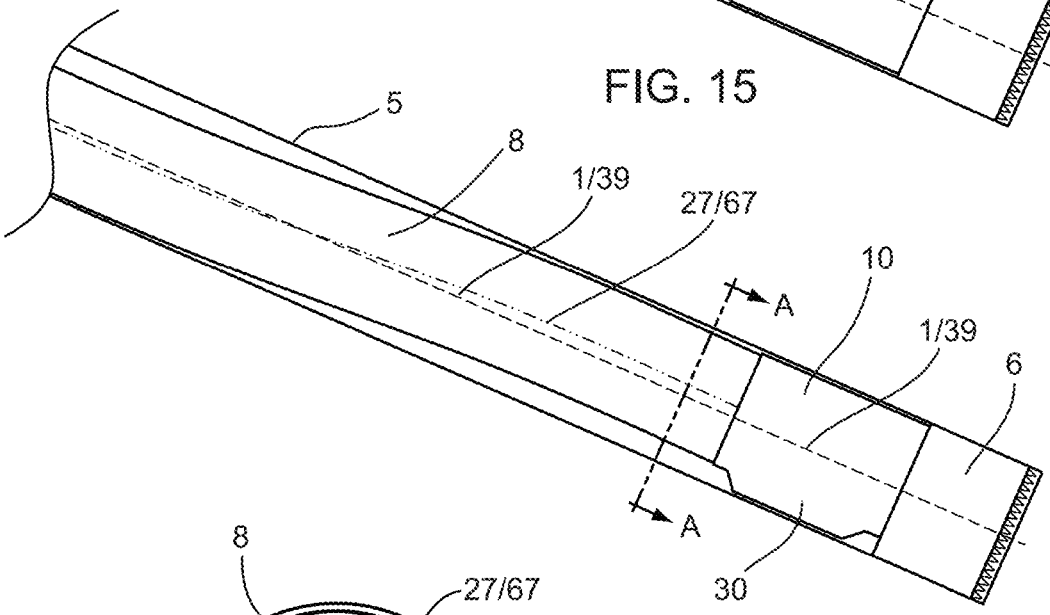
FIG. 16 is a side view of an embodiment of the axis-offset cam drilling tool within a drill hole, in accordance with the present disclosure.
Figure 17:
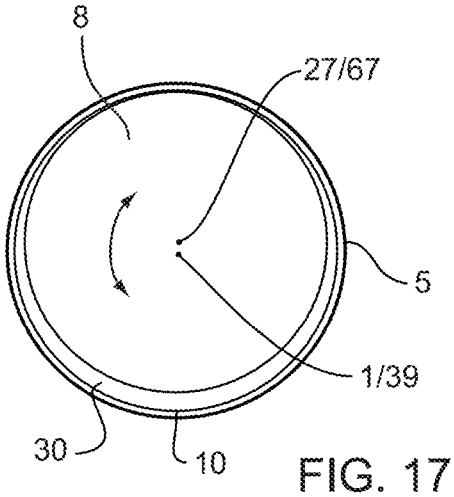
FIG. 17 is a cross-sectional end view of an embodiment of the axis-offset cam drilling tool within a drill hole taken along the line A-A of FIG. 16, in accordance with the present disclosure.

The configuration of the off-axis "cam" drilling tool 10, as described herein, may be coupled in the drill string 8 and thereafter utilized to periodically lift, raise, exert force thereon, bow, deflect, or elastically bend the drill string 8 to move the axis of the drill string 8 out of the centerline axis 1 of the drill hole 5 and even above the centerline axis 1, as described herein and as depicted in FIGS. 16 and 17. With the off-axis "cam" drilling tool 10 inserted within the drill string 8 at some point between the drill bit 6 and the drill rods 4, the centerline of the drill string 8 can be periodically offset or otherwise displaced from the centerline 1 of the drill hole 5 as a result of the rotation of the tool 10 within the drill hole 5, and in particular as a result of the offset section on the cam section 30 contacting the bottom surface of the drill hole 5 to raise the drill string 8 up off the bottom surface of the drill hole 5, as exemplarily depicted in FIG. 16, to keep the drill bit 6 on target. This is different than in conventional reverse circulation drilling configurations where the centerline of the drill string is substantially and consistently the same as, or lower than, the centerline of the drill hole along the length of the drill hole as well as at the point the drill string meets the drill bit or drill bit adapter, even while the conventional reverse circulation drilling system is rotating, according to FIG. 6A.

But, as stated, embodiments of the off-axis "cam" drilling tool 10 of the present disclosure establish advantages over the conventional drill string and drilling system described in FIG. 6A. For example, because the axis 27 of the first and second bodies 120 and 140 and the axis of the drill string 8 at the connection point between the off-axis "cam" drilling tool 10 and the drill string 8 are substantially the same, and because the axis 39 of the off-axis cam section 30 is substantially the same as the centerline 1 of the drill hole 5 (due to the off-axis cam section 30 being substantially the same diameter as the drill hole 5), and because the axis 27 of the first and second bodies 120 and 140 is not in alignment with the axis 39, the centerline axis of the drill string 8 is periodically brought out of alignment with the centerline 1 of the drill hole 5 as the drill string 8 rotates. For example, as the drill string 8, the off-axis "cam" drilling tool 10 and drill bit 6 rotate within the drill hole 5, the axis 27 of the first and second bodies 120 and 140 rotates radially about the axis 39 of the off-axis cam section 30 and thus the centerline of the drill string 8 rotates radially about the axis 39 of the off-axis cam section 30, when viewed axially down the drill hole 5, as exemplarily depicted in FIG. 17, which is a view taken along the line A-A in FIG. 16. As a result, the drill string 8 can be periodically positioned and/or lifted above the centerline axis 1 of the drill hole 5, which positioning exerts periodic forces on the drill string 8 to cause the drill string 8 to periodically bend, curve, deflect, bow or otherwise arc at some point along the drill string 8 to exert forces on the drill bit 6 that cause the drill bit 6 to resist the natural forces of gravity G that might otherwise cause the drill bit 6 to dip.

With the off-axis "cam" drilling tool 10 coupled to the drill string 8, the tool 10 can be utilized to combat the forces exerted on the drill string 8 due to gravity G. Gravity G, acting on the weight of the drill string 8 and the drill bit 6, naturally wants to pull the drill string 8 and the drill bit 6 down toward the center of the Earth, which causes the conventional drill string 8 and conventional drill bit 6 to dip over time. However, the drilling tool 10 can be used to advantageously position the drill bit 6. As the drilling tool 10 rotates with the rotation of the drill string 8, the off-axis "cam" drilling tool 10 periodically raises the drill string 8 above the centerline 1 of the drill hole 5 when the cam section 30 contacts the bottom surfaces of the drill hole 5, as exemplarily depicted in FIG. 16. By transitioning the centerline of the drill string 8 periodically above the centerline 1 of the drill hole 5, the natural forces of gravity G acting on the drill string 8 and the force of the drilling tool 10 acting against gravity G serve to periodically bow, deflect, or elastically bend the drill string 8 to cause a periodic deflection in the centerline axis of the drill rods 4, which consequently and periodically affects the directional orientation of the drill bit 6 against the natural forces of gravity G. In other words, the periodic centerline deflection of the drill rods 4, and thus the drill string 8, beneficially affects the directional orientation of the drill bit 6 in a direction contrary to the natural effects of gravity G. Also, the inertial effect of the centerline of the drill string 8 rotating about the centerline of the drill hole 5 may tend to periodically affect the directional orientation of the drill bit 6 against the natural forces of gravity G prevent the drilling system from substantially deviating from the intended direction. Indeed, equipping the off-axis "cam" drilling tool 10 in a reverse circulation drilling system in the manner herein described effectively eliminates the drilling system from deviating on "dip angle" and "azimuth control" more than is desired, and thus allowing the drilling system to intercept the intended target.

As mentioned herein, embodiments of the off-axis "cam" drilling tool 10 may further comprise the off-axis cam section 30 being configured to have a larger or smaller offset distance OD from the axis 27 as the angle of the drill hole 5 increases or decreases from the vertical, respectively. In other words, as the orientation of the drill hole 5 is oriented further from the vertical, it may be necessary to adjust the offset distance OD of the off-axis cam section 30 with respect to axis 27 to help the drill bit 6 achieve the most appropriate directional orientation. As the orientation of the drill hole 5 moves further and further from the vertical, the effects of gravity on the drill string 8 and the drill bit 6 that orient the drill string 8 and drill bit 6 within the drill hole 5 increase. Accordingly, it may be necessary to increase the offset distance OD to combat these larger effects of gravity. Alternatively, as the orientation of the drill hole 5 moves closer and closer to the vertical, the effects of gravity on the drill string 8 and the drill bit 6 that orient the drill string 8 and drill bit 6 within the drill hole 5 decrease. Accordingly, it may be necessary to decrease the offset distance OD to offset these smaller effects of gravity. Implementing the off-axis cam section 30 with larger or smaller offset distances OD may require that one or more cam drilling tools 10 are manufactured with different offset distances OD according to the needs, type, and orientation of the drill hole 5 to be drilled. In addition to the effects of gravity G, the ground condition or ground type may be factored into the analysis and decision of what offset distance OD should be chosen for any particular drill hole 5 to be drilled.

Figure 18:
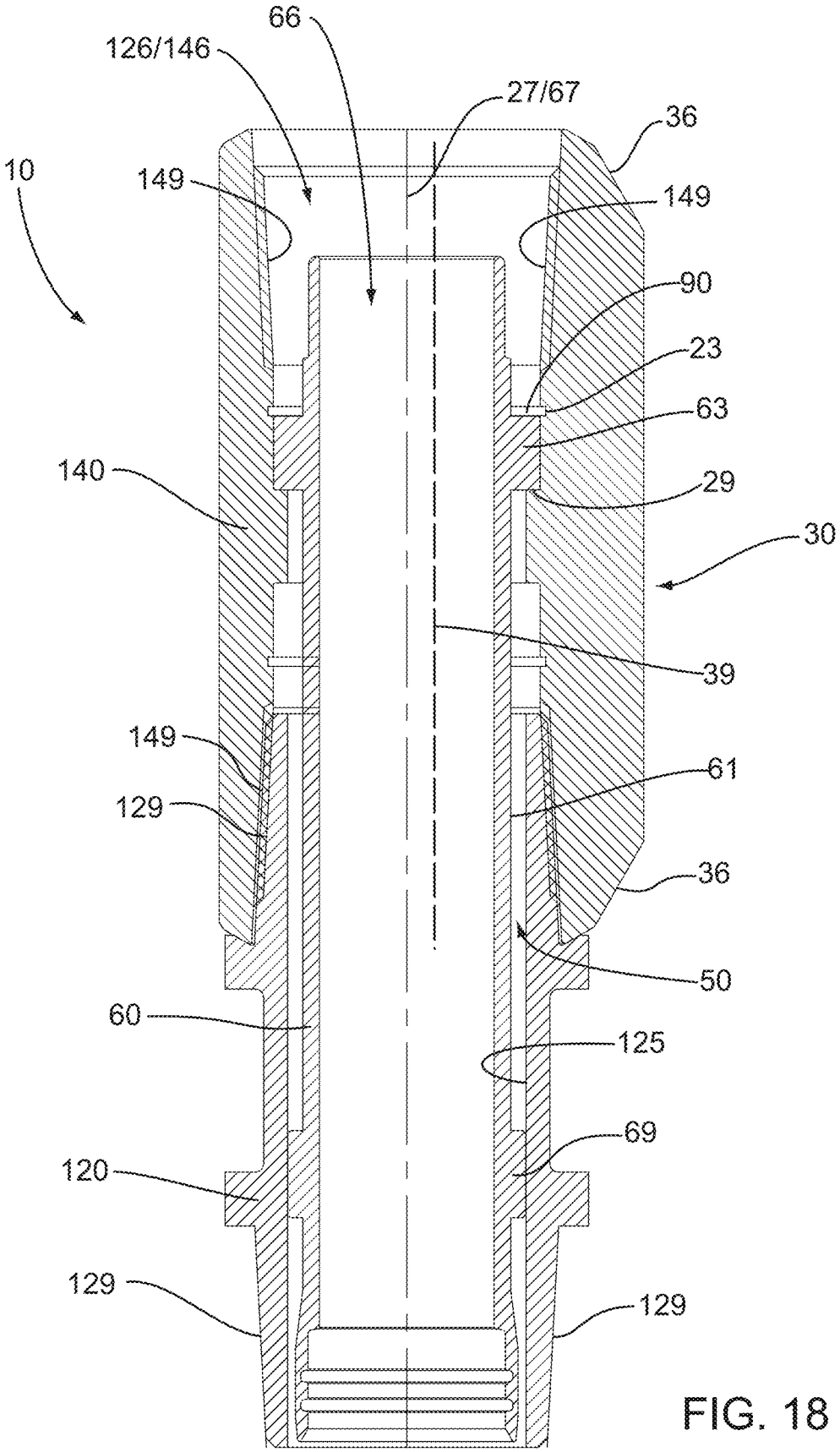
FIG. 18 is a cross-sectional side view of the embodiment of the axis-offset cam drilling tool depicted in FIG. 12, in accordance with the present disclosure.

As depicted in FIG. 18, embodiments of the off-axis "cam" drilling tool 10 may further comprise the second body 140 having the interior lip 29 and the interior grove 23, as described above with respect to embodiments heretofore presented, on the surface 145 of the through bore 146. The interior lip 29 may be configured to receive and communicate with the inner tubing 60, as described above with respect to previous embodiments. Further, the interior groove 23 may be configured to receive the c-ring clip 90 therein. The clip 90 may be configured to be inserted into and sit within the interior groove 23 and communicate with not only the second body 140 but also the inner tubing 60, such that the clip 90 may prevent axial retreat of the inner tubing 60 with respect to the second body 140 once the second body 140 and the inner tubing 60 have been positioned relative to one another and the clip 90 has been positioned within the groove 23, as described herein.

With reference to FIG. 18, embodiments of the off-axis "cam" drilling tool 10 may further comprise the inner tubing 60 being configured to be inserted within the combined bores 126 and 146 of the first and second body 120 and 140, respectively. Once coupled together, combined bores 126 and 146 may function similarly to that of through bore 26 of the outer tubing 20, as described above with respect to previous embodiments. For example, under the condition that the inner tubing 60 is positioned within first and second body 120 and 140, the axis 67 of the inner tubing 60 and axes of the first and second body 120 and 140 coincide, such that they are the same axis. The axes of the first and second body 120 and 140 are substantially the same as the axis 27 of the outer tubing 20, described above. Once the inner tubing 60 is inserted within the first and second body 120 and 140, the spacers 69 may slide down past the interior lip 29 of the second body 140 and contact the interior surface 125 of the first body 120 at a position toward the second end 124. On the other hand, the spacers 63 may function to contact and functionally engage the interior lip 29 of the second body 140, such that the inner tubing 60 is prevented from further axially advancing down into the through bores 126 and 146. Additionally, as mentioned above, the clip 90 may be inserted within the interior groove 23 of the second body 140, such that the clip 90 is secured within the interior groove 23. At the same time, the clip 90 may be configured to contact the spacers 63 to prevent the axial retreat of the inner tubing 60 from within the through bores 126 and 146 of the first and second body 120 and 140, respectively. As such, the inner tubing 60 is positioned within the 126 and 146 of the first and second body 120 and 140, respectively, and is structurally and functionally coupled to the first and second body 120 and 140, such that they function as one off-axis "cam" drilling tool 10. Indeed, once properly seated, an annulus 50 is defined between the combined interior surfaces 125 and 145 of the first and second body 120 and 140, respectively, and the exterior surface 61 of the inner tubing 60. The annulus 50 provides a pathway for a circulation medium, usually high-pressure air, to pass therethrough under the condition that RC drilling methods are utilized with the off-axis "cam" drilling tool 10. During RC drilling, the circulation medium may travel down a corridor in the drill rods 4 from the surface of the Earth until the circulation medium reaches the annulus 50 of the tool 10. The circulation medium may pass down through the annulus 50 to reach the drill bit 6, at which time the drilling system utilizes the circulation medium to pick up loose debris from the effects of the drill bit 6 and transports the loose debris back up through the through bore 66 of the inner tubing 60 and through the hollow drill rods 4 and back up to the surface of the Earth.

Embodiments of the off-axis "cam" drilling tool 10 may further comprise the tool 10 being utilized in drilling applications other than reverse circulation (RC) drilling, such as other known or yet unknown rotational drilling methods where the cam section 30 may be utilized on the exterior surface of a part of the drill string 8 to help guide the drill bit 6 deep into the Earth with desired accuracy. For example, the drilling tool 10 of the present invention may comprise one or more embodiments, including for example, the outer body 20 having the cam section 30 integral therewith, the first body 120 and the second body 140 with the sleeve 160 having the cam section 30 thereon, and the first body 120 and the second body 140 with the cam section 30 integral with the second body 140, each being utilized in rotational drilling techniques other than RC drilling without the need to include the inner tubing body 60 within the outer body 20 or its equivalent. Indeed, the inner tubing 60 may be removed from the tool 10, or never included with the tool 10, and the tool 10 may be connected in series with the drill string 8 of these rotational drilling techniques. In this way, the tool 10 having the cam section 30 thereon, as described herein, may be inserted in the drill string 8 of these rotational drilling techniques and the tool 10 may rotate with the drill string 8 to bring the cam section 30 in contact with the appropriate surfaces of the drill hole 5 to accurately guide the drill bit 6, as described herein.

Methods of drilling a hole and directing or otherwise guiding the drill bit within the hole may be performed utilizing embodiments of the drilling tool 10 herein described. The methods may encompass the structure and function of the embodiments of the component parts of the drilling tool 10 described herein. For example, a method of deep hole drilling may comprise providing a drilling system such as a drilling rig and other essential components of the drilling system, including but not limited to, a power source, a motor, engine or other rotational force generator, and various sensors. The method may further comprise providing a drill string of drill rods, drill bits, and other drill inserts, as needed, inserting a drilling tool of the present disclosure in the drill string at a point between the drill bit and the drill rods, and drilling a drill hole using the drill string having the drilling tool positioned therein, and guiding the drill bit by adjusting an offset distance between two diameters on the drilling tool, as described above in embodiments of the tool. The method may further comprise the first and second diameters being internally tangent on a side of the drilling tool to create the offset distance on an opposing side of the drilling tool. The method may also further comprise periodically displacing the drill string within the drill hole due to rotation of the drill string and the offset distance. The method may also further comprise removing the drilling tool from the drill string to adjust parts of the drilling tool or adjust the offset distance, as desired, depending on such factors as life of the tool, hours of use of the tool, angle of the drill hole, and location of the intended target within the Earth. The method may also further comprise replacing the drilling tool within the drill string. The method may further comprise utilizing two or more drilling tools as described herein within the drill string. The method may further comprise drilling a predetermined depth into the ground, adjusting the offset distance, drilling another predetermined depth into the ground at the same location, adjusting the offset distance again, and drilling yet another predetermined depth into the ground. Such method may be repeated until the desired target has been reached. For example, the offset distance may be adjusted as often as needed to reach the intended target.

Accordingly, the components defining any off-axis "cam" drilling tool 10 may be formed of any of many different types of materials or combinations thereof that can readily be formed into shaped objects provided that the components selected are consistent with the intended operation of the off-axis "cam" drilling tool 10. For example, but not in any way limited thereto, the components may be formed of: polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining the off-axis "cam" drilling tool 10 may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the present disclosure, as required by the following claims. The claims provide the scope of the coverage of the present disclosure and should not be limited to the specific examples provided herein.

What is claimed is:

1. A drill string tool configured to be placed in a drill string, the tool comprising:

a tubular body having a central longitudinal axis and a through bore defined by a sidewall, an exterior portion of the sidewall having a sidewall cylindrical surface, the sidewall cylindrical surface having a first diameter;

a cam body configured on the tubular body, an exterior portion of the cam body having a cam cylindrical surface, the cam cylindrical surface having a second diameter;

an offset section on the cam body defined by the first and second diameters being substantially internally tangent with respect to a first side of the tool, such that the offset section protrudes from the cam body with respect to a second side of the tool opposite the first side;

a clip; and a key;

wherein the tubular body having the cam body thereon is configured to be inserted in a drill string and to rotate with the drill string;

wherein the offset section comprises a central longitudinal offset axis, the central longitudinal axis and the central longitudinal offset axis being offset an offset distance from one another and substantially parallel with one another;

wherein the tubular body is comprised of a first body and a second body that are configured to be releasably and repeatedly coupled in series to form the tubular body;

wherein the cam body is a sleeve, the sleeve being configured to be repeatedly and releasably functionally coupled on the tubular body;

wherein the second body having an interior groove is configured to receive the clip; and wherein the through bore defined by an interior surface having an indentation is configured to receive the key.

2. The drill string tool of claim 1, further comprising an internal tubular body that is configured to be inserted within the through bore of the tubular body to functionally engage the tubular body, the tubular body and the internal tubular body defining a hollow annulus therebetween.

3. The drill string tool of claim 1, wherein the offset section comprises tapered leading edges.

4. The drill string tool of claim 1, wherein the offset section comprises one or more grooves therein.

5. The drill string tool of claim 1, wherein the sidewall cylindrical surface and the cam cylindrical surface are each substantially parallel with the axis.

6. The drill string of claim 1, wherein the offset section has an axial length less than a length of the tubular body.

7. A drill string tool configured to be placed in a drill string, the tool comprising:

an inner tubing;

an outer tubing having a through bore, the outer tubing being configured to receive at least a portion of the inner tubing within the through bore, the inner and outer tubing being configured to rotate about a central longitudinal first axis;

a hollow annulus defined between the inner tubing and the outer tubing;

a cam section extending from an exterior surface of the outer tubing, the cam section having a central longitudinal cam axis that is substantially parallel to the central longitudinal first axis and offset an offset distance from the central longitudinal first axis;

a clip; and a key;

wherein under a condition the tool is coupled to a drill string and the drill string is rotated within a drill hole, the cam section is configured to periodically lift a portion of the drill string off a surface of the drill hole;

wherein the outer tubing is comprised of a first body and a second body that are configured to be releasably and repeatedly coupled in series to form the outer tubing;

wherein the cam section is a sleeve, the sleeve being configured to be repeatedly and releasably functionally coupled on the outer tubing;

wherein the second body having an interior groove is configured to receive the clip; and wherein the through bore defined by an interior surface having an indentation is configured to receive the key.

8. The drill string tool of claim 7, wherein the outer tubing has a first diameter and the cam section has a second diameter larger than the first diameter.

9. The drill string tool of claim 8, wherein the second diameter of the cam section is configured to functionally engage the drill hole during rotation of the drill string and results in the first axis rotating about the cam axis in the tool to periodically lift the portion of the drill string off the surface of the drill hole.

10. The drill string tool of claim 8, wherein the first diameter and the second diameter are each cylindrical-shaped surfaces.

11. The drill string tool of claim 7, wherein the cam section comprises tapered leading edges.

12. The drill string tool of claim 7, wherein the cam section comprises one or more grooves therein.

* * * * *